US007588445B2

(12) United States Patent
He et al.

(10) Patent No.: US 7,588,445 B2
(45) Date of Patent: Sep. 15, 2009

(54) STACKED ELECTRICAL CONNECTOR WITH IMPROVED SIGNAL TRANSMISSION

(75) Inventors: Jia-Yong He, Kunshan (CN); Qi-Sheng Zheng, Kunshan (CN); Hao Gu, Kunshan (CN); Yu-Long Mao, Kunshan (CN); Feng Qiao, Kunshan (CN)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 12/228,390

(22) Filed: Aug. 11, 2008

(65) Prior Publication Data

US 2009/0042448 A1 Feb. 12, 2009

(30) Foreign Application Priority Data

Aug. 10, 2007 (CN) ..... 2007 1 0025933
Aug. 10, 2007 (CN) ..... 2007 2 0042746 U
Aug. 10, 2007 (CN) ..... 2007 2 0042747 U

(51) Int. Cl.
*H01R 12/00* (2006.01)

(52) U.S. Cl. ..... 439/79

(58) Field of Classification Search ..... 439/541.5, 439/79, 80

See application file for complete search history.

(56) References Cited

U.S. PATENT DOCUMENTS 5,161,997 A * 11/1992 Defibaugh et al. ..... 439/532
7,021,971 B2 4/2006 Chou et al.
7,104,848 B1 9/2006 Chou et al.
7,108,560 B1 9/2006 Chou et al.
7,125,287 B1 * 10/2006 Chou et al. ..... 439/660
7,134,884 B2 11/2006 Wang et al.
2009/0042450 A1 * 2/2009 Zheng et al. ..... 439/660

* cited by examiner

*Primary Examiner*—Phuong K Dinh
(74) *Attorney, Agent, or Firm*—Wei Te Chung

(57) ABSTRACT

A stacked electrical connector includes a first mating interface. The first mating interface comprises a first receiving space (101) with a first tongue (102). The first tongue (102) has a pair of upper and lower face (1021, 1022). A plurality of first contacts (20) are retained in the first mating interface. The first contacts (20) include a plurality of first elastic contacts (201) and a plurality of first flat contact (202). Each first elastic contact (201) has a securing portion (2011) fixed in the first mating interface (101), an elastic contact portion (2010) extending to the first tongue (102) and a soldering portion (2012). Each first flat contact (202) has a retention portion (2024, 2028) retained in the first mating interface (101), a flat contact portion (2022, 2026) extending to the first tongue (102) and a tail portion (2025, 2029). The flat contact portions (2022, 2026) and the elastic contact portions (2010) are located at a same side of the upper face (1021), and are arranged in two rows along a length direction of the first tongue (102). A second mating interface is stacked with the first mating interface along a thickness direction of the first tongue (102). A plurality of second contacts (21) are retained in the second mating interface.

5 Claims, 28 Drawing Sheets

STACKED ELECTRICAL CONNECTOR WITH IMPROVED SIGNAL TRANSMISSION

BACKGROUND OF THE INVENTION

1. Field of the Invention

The present invention relates to an stacked electrical connector, and more particularly to stacked electrical connectors with improved signal transmission.

2. Description of Related Art

Universal Serial Bus (USB) is used widely in variety electric devices as a standard and simple interface. As of 2006, the USB specification was at version 2.0 (with revisions). The USB 2.0 specification was released in April 2000 and was standardized by the USB-IF at the end of 2001. Previous notable releases of the specification were 0.9, 1.0, and 1.1. Equipment conforming to any version of the standard will also work with devices designed to any previous specification (known as: backward compatibility).

USB mentioned above supports three data rates respectively as follows: 1) A Low Speed rate of up to 1.5 Mbit/s (187.5 KB/s) that is mostly used for Human Interface Devices (HID) such as keyboards, mice, and joysticks; 2) A Full Speed rate of up to 12 Mbit/s (1.5 MB/s). Full Speed was the fastest rate before the USB 2.0 specification and many devices fall back to Full Speed. Full Speed devices divide the USB bandwidth between them in a first-come first-served basis and it is not uncommon to run out of bandwidth with several isochronous devices. All USB Hubs support Full Speed; 3) A Hi-Speed rate of up to 480 Mbit/s (60 MB/s).

However, as the development of electric industry, even the USB 2.0 can not satisfied the requirement of many electric devices. For example, under a circumstance transmitting an audio or video file, which is always up to hundreds MB, even to 1 or 2 GB, currently transmission rate of USB is not sufficient. As a consequence, faster serial-bus interfaces are being introduced to address different requirements. PCI Express, at 2.5 GB/s, and SATA, at 1.5 GB/s and 3.0 GB/s, are two examples of High-Speed serial bus interfaces.

However, these non-USB protocols, such as PCI Express which is useful for its higher possible data rates, a 26-pin connectors and wider card-like form factor limit the use of Express Cards, and SATA which uses two connectors, one 7-pin connector for signals and another 15-pin connector for power, are not used as broadly as USB protocols. Many portable devices are equipped with USB connectors other than these non-USB connectors. One important reason is that these non-USB connectors contain a greater number of signal pins than an existing USB connector and are physically larger as well, especially in a stacked electrical connector. Due to its clumsiness, the PCI Express and SATA connector can not adapt to the development trend of gently, thin, short and small size.

USB connector is soldered on a circuit board of an computer usually. The USB 2.0 A type connector according to USB-IF usually comprises an insulative housing with a tongue plate extending forwardly, four contacts retained in the insulative housing and a metal shield. Each contact has a contact portion extending to a lower side of the tongue plate and exposing out thereof flexibly. The contact portion presents as arc type and can move along a thickness direction of the tongue. The four contacts comprise a power contact, a ground contact, a – data contact and a + data contact. The – data contact and + data contact present as a pair of differential signal contacts which are located between the power contact and the ground contact. The metal shield encloses the tongue plate and forms a first receiving space for receiving a USB plug.

Hence, an stacked electrical connector which is based USB interface, but has a high signal transmission and a simple structure, is desired to overcome the disadvantage of the prior art.

BRIEF SUMMARY OF THE INVENTION

According to the present invention, a stacked electrical connector comprises a first mating interface with a plurality of first contacts retained therein. The first mating interface comprises a first receiving space with a first tongue received therein. The first contacts comprise a plurality of first elastic contacts and a plurality of first flat contact. Each first elastic contact has a securing portion fixed in the first mating interface, an elastic contact portion extending to the first tongue and a soldering portion. Each first flat contact has a retention portion retained in the first mating interface, a flat contact portion extending to the first tongue and a tail portion. The first tongue has a pair of opposite upper face and lower face. A second mating interface is stacked with the first mating interface along a thickness direction of the first tongue. A plurality of second contacts are retained in the second mating interface. The flat contact portions and the elastic contact portions are located at a same side of the upper face, and are arranged in two rows along a length direction of the first tongue.

According to another aspect of the present invention, a stacked electrical connector comprises a first mating interface comprising a first receiving space with a first tongue received therein. A geometric profile of the first tongue is substantially same as what of a standard USB 2.0 A type receptacle. A plurality of first contacts are retained in the first mating interface. The first contacts comprise a group of first type contacts and a group of second type contacts. Each first and second type contact has a contact portion. The contact portions of the first type contacts and the contact portions of the second portions are exposed in the first receiving space in an offset manner in both a front-to-back direction and a vertical direction perpendicular to said front-to-back direction. A second mating interface is stacked with the first mating interface along a thickness direction of the first tongue. A plurality of second contacts are retained in the second mating interface.

The foregoing has outlined rather broadly the features and technical advantages of the present invention in order that the detailed description of the invention that follows may be better understood. Additional features and advantages of the invention will be described hereinafter which form the subject of the claims of the invention.

BRIEF DESCRIPTION OF THE DRAWINGS

For a more complete understanding of the present invention, and the advantages thereof, reference is now made to the following descriptions taken in conjunction with the accompanying drawings, in which.

DETAILED DESCRIPTION OF THE PREFERRED EMBODIMENT

Figure 1:
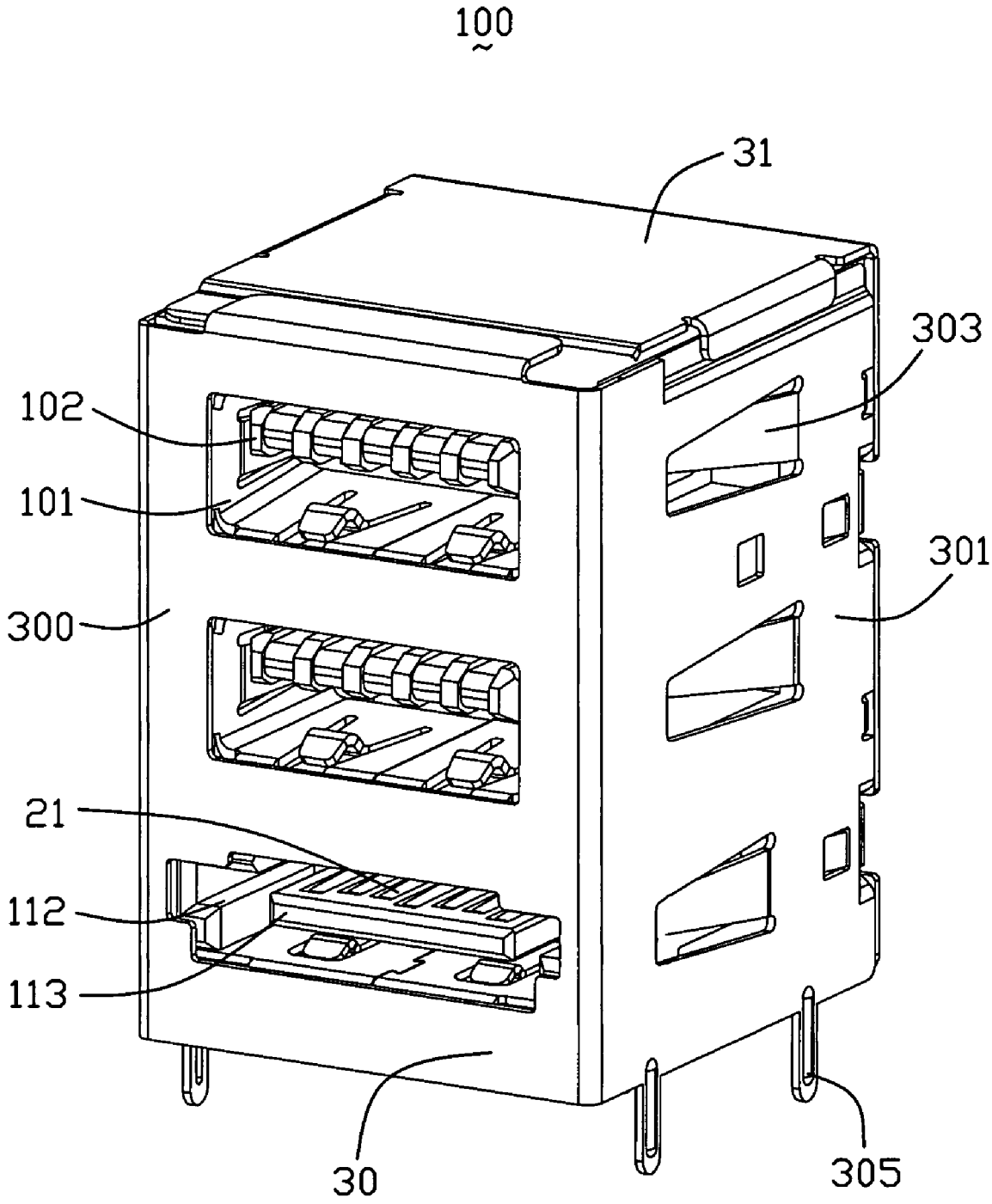
FIG. 1 is a perspective view of an stacked electrical connector according to a first embodiment of the present invention.
Figure 2:
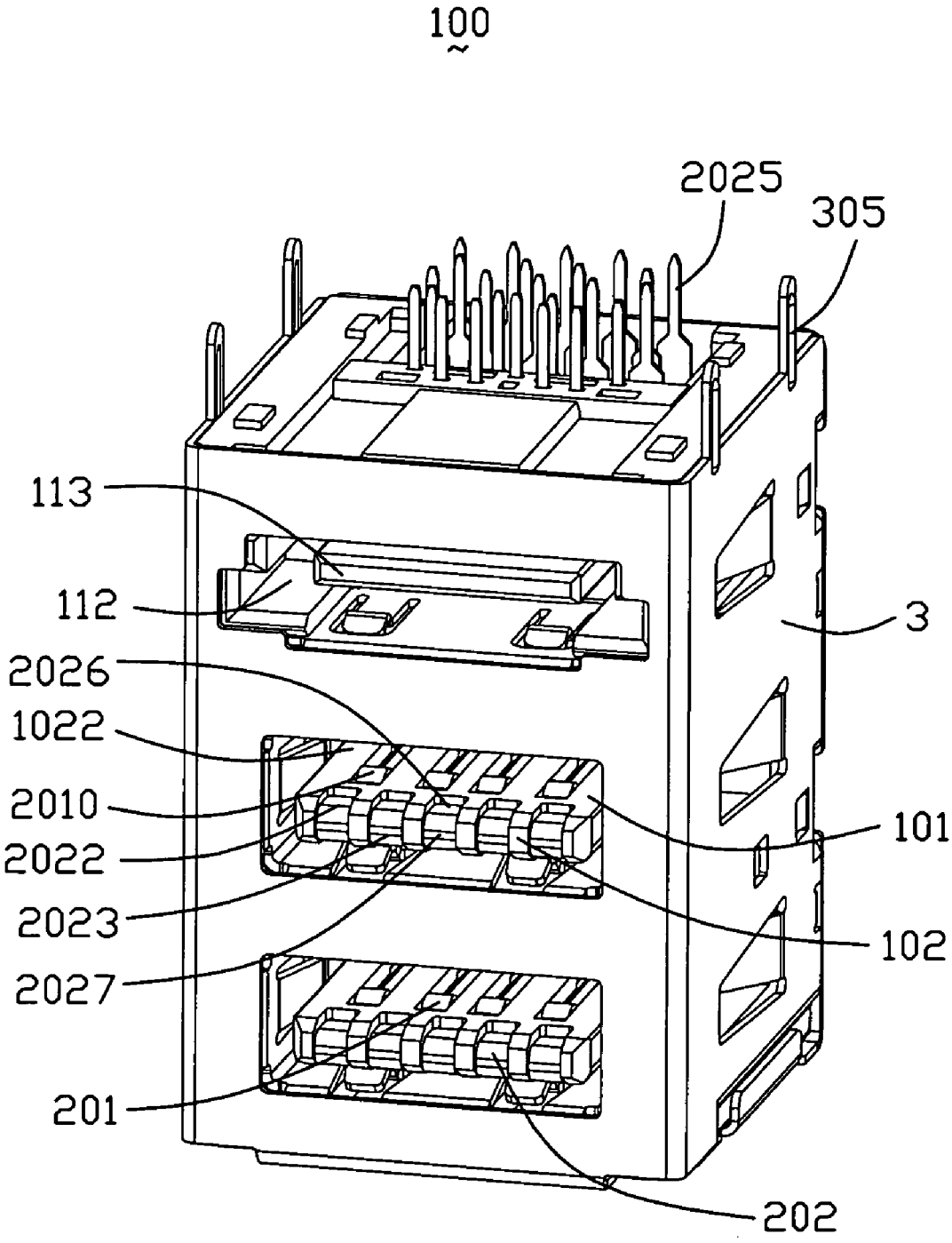
FIG. 2 is a view similar to FIG. 1, while taken from another aspect.
Figure 3:
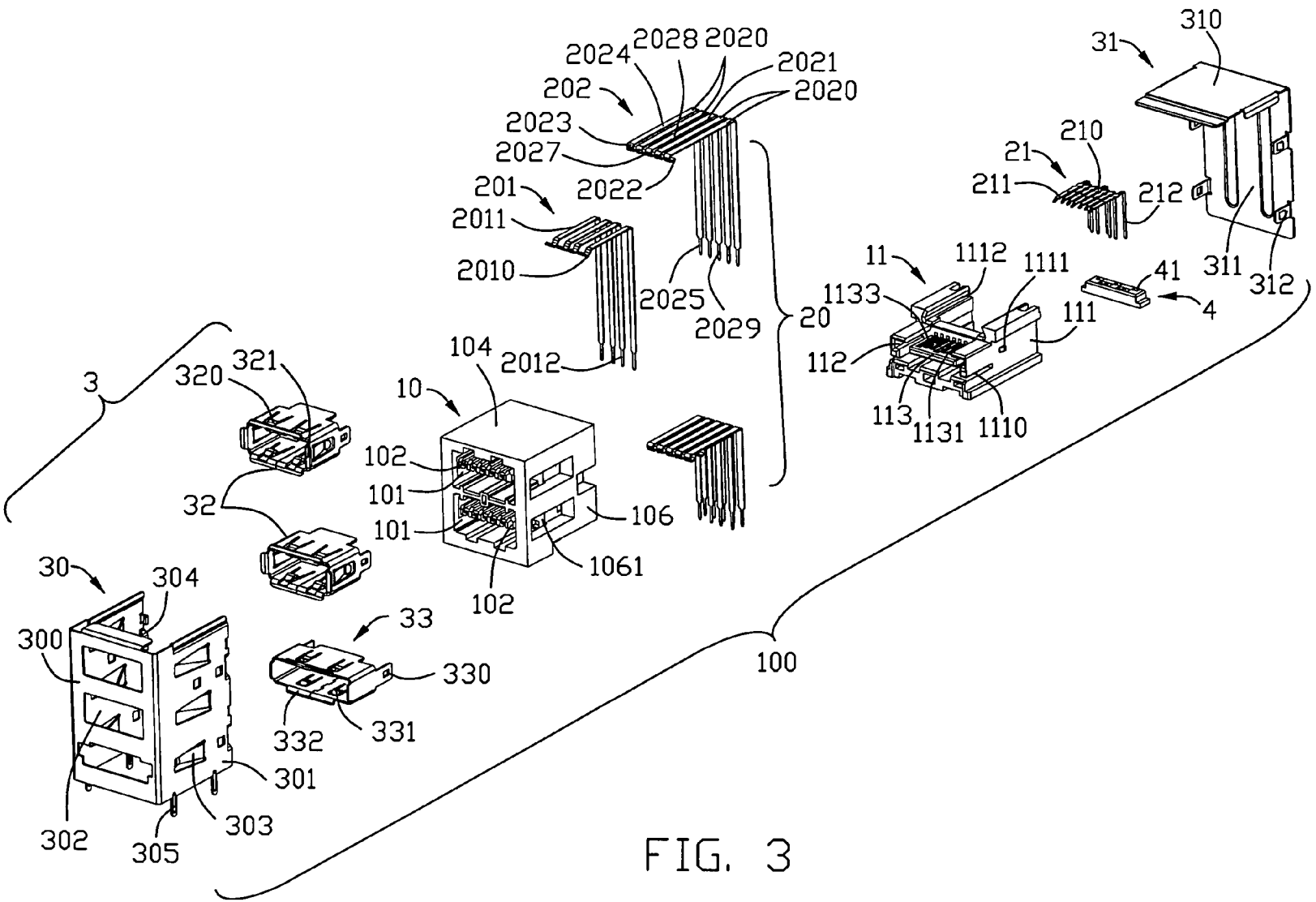
FIG. 3 is an exploded view of the stacked electrical connector shown in FIG. 1.
Figure 4:
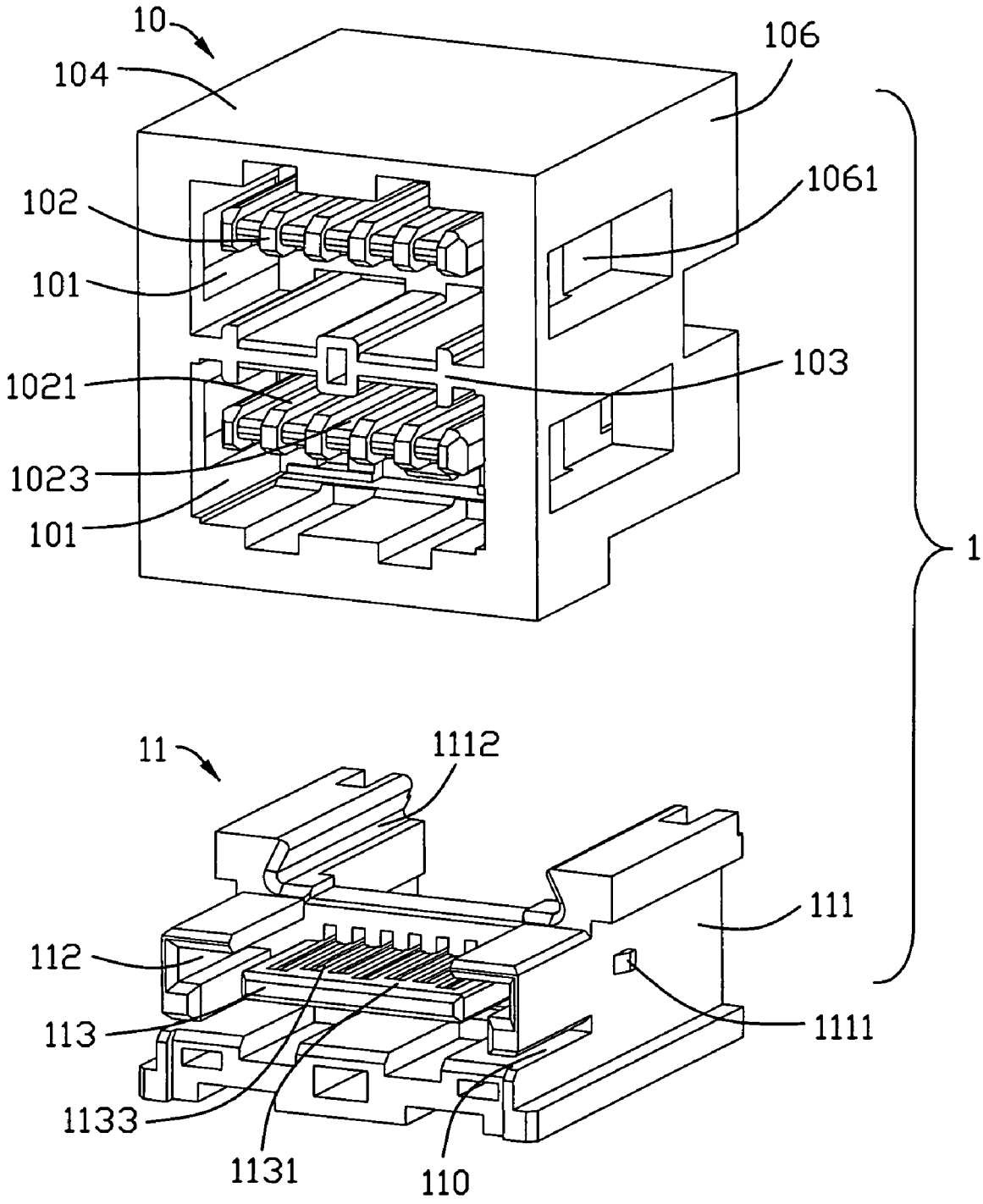
FIG. 4 is a exploded view of an insulative housing of the stacked electrical connector.
Figure 5:
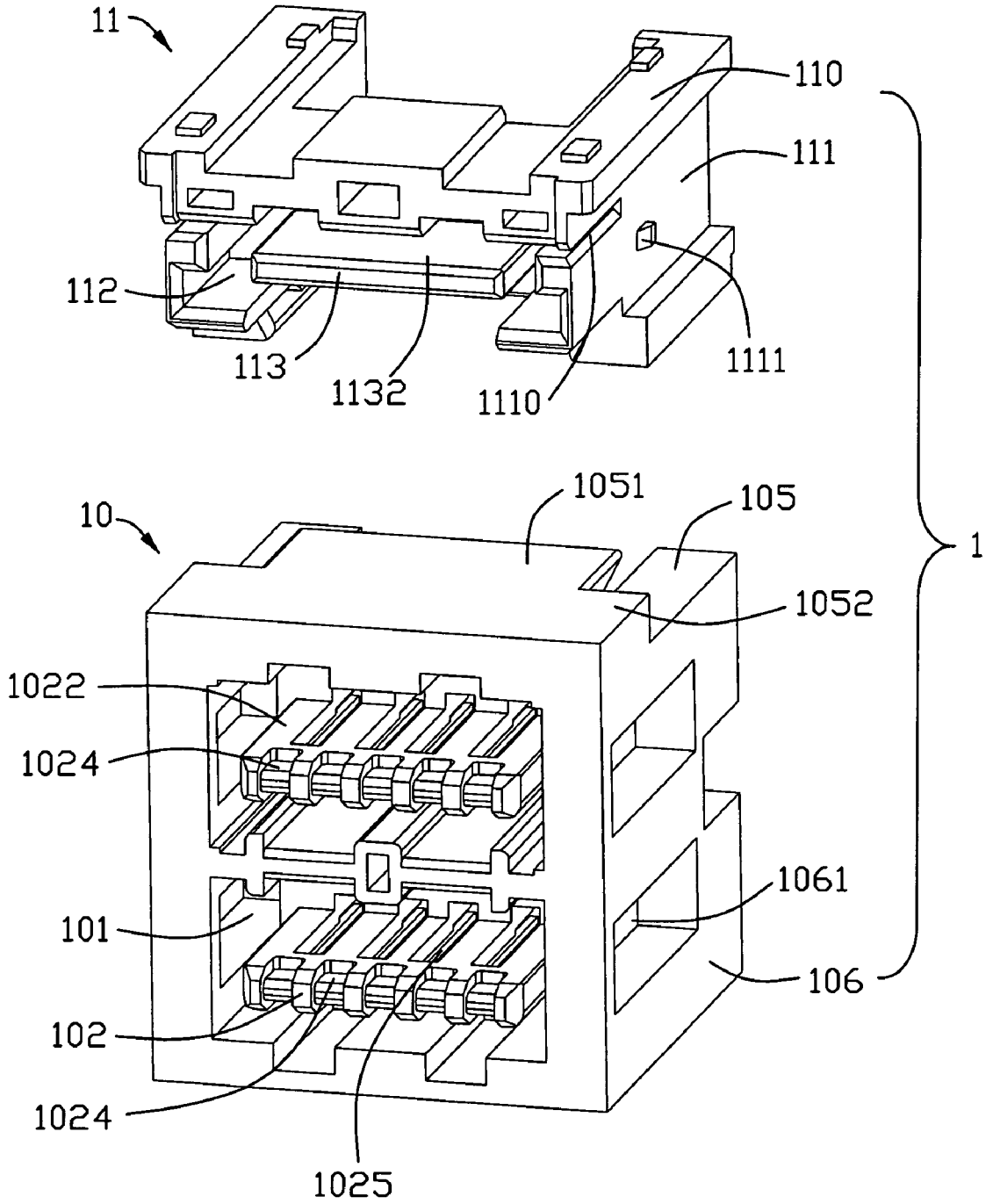
FIG. 5 is a view similar to FIG. 4, while taken from another aspect.

In the following description, numerous specific details are set forth to provide a thorough understanding of the present invention. However, it will be obvious to those skilled in the art that the present invention may be practiced without such specific details. In other instances, well-known circuits have been shown in block diagram form in order not to obscure the present invention in unnecessary detail. For the most part, details concerning timing considerations and the like have been omitted inasmuch as such details are not necessary to obtain a complete understanding of the present invention and are within the skills of persons of ordinary skill in the relevant art.

Referring to FIGS. 1-5, an stacked electrical connector 100 according to a first embodiment of the present invention is disclosed. The stacked electrical connector 100 comprises an insulative housing 1, a plurality of contacts 2 retained in the insulative housing 1, a metal shield 3 enclosing the insulative housing 1 and a spacer 4 for fixing the contacts 2.

The insulative housing 1 comprises a first housing 10 and a second housing 10 stacked with each other along a vertical direction. The first housing 10 has two first mating interfaces stacked with each other along the vertical direction. The structure of the first mating interface is similar to that of an existing standard USB 2.0 A type receptacle (not shown). The first mating interface comprises a first receiving space 101 with a first tongue 102 received therein. A geometric profile of the first tongue 102 is substantially same as that of a standard USB 2.0 A type receptacle.

The first tongue 102 has a pair of opposite upper face 1021 and lower face 1022. The first tongue 102 defines five first passageways 1023 juxtaposed with respect to each other in a width direction of the first tongue 102, and extending through the first housing 10 along a front-to-back direction. The first passageways 1023 are concaved inwardly from the upper face 1021. The front-to-back direction is same with a length direction of the first tongue 102. The vertical direction is same with a thickness direction of the first tongue 102. A plurality of second and third passageways 1024, 1025 are concaved inwardly from the lower face 1022. There are five second passageways 1024 juxtaposed with respect to each other in the width direction. The second passageways 1024 extend to a front end of the first tongue 102 and communicate with the first passageways 1023 respectively. There are four third passageways 1025 juxtaposed with respect to each other in the width direction. The third passageways 1025 extend to a rear end of the first housing 10. The second and third passageways 1024, 1025 are arranged in two rows along the length direction and do not communicate with each other.

A clapboard 13 extends forwardly between two first mating interfaces for dividing them. The first housing 10 comprises a top wall 104, a bottom wall 105 and a pair of side walls 106 therebetween. The first receiving spaces 101 of the two first mating interface are formed between the top wall 104, bottom wall 105 and side walls 106. Two side walls 106 are located at outsides of first tongue 102 respectively, and each side wall 106 defines an opening 1061 corresponding to each first receiving space 101. A projection 1051 projects downwardly from the bottom wall 105. The bottom wall 105 has a rib 1052 extending downwardly and located at a front position of the projection 1051.

The second housing 11 comprises a lower wall 110 and two side walls 111. The lower wall 110 and two side walls 111 define a second mating interface therebetween. The second mating interface has a second receiving space 112 with a second tongue 113 received therein. The second receiving space 112 is wider than the first receiving space 101. The second mating interface presents as crisscross shape and is a standard External Serial ATA interface. The second housing 11 comprises a base portion 114. The second tongue 113 extends forwardly from the base portion 114 and comprises a pair of opposite upper and lower faces 1131, 1132. A plurality of contact passageways 1133 are concaved inwardly from the upper face 1131. The second housing 11 defines a pair of apertures 1110 extending backwardly from a front end thereof and formed between the side wall 111 and lower wall 110. Each side wall 111 has a protrusion 111 extending outwardly and a slot 1112 extending along the front-to-back direction at an upper position thereof. The slot 1112 engages with the projection 1051 for fastening the first and second housing 10, 11 together. The side walls 111 present as step shape at a top position to abut against the rear end of the rib 1052 for preventing the first housing 10 from moving backwardly.

The insulative housing 1 of the stacked electrical connector 100 in the first embodiment is divided into two parts. In nature, the insulative housing 1 can be formed integrally. The first and second mating interfaces are formed in an integral insulator for assembling conveniently.

The contacts 2 comprise a plurality of first contacts 20 retained in the first mating interface and a plurality of second contacts 21 retained in the second mating interface.

The first contacts 20 are divided in two groups retained in two mating interfaces of the first housing 10. Two groups of the first contacts 20 have same structure, so we will describe one group of the first contacts 20 in follows. The first contacts 20 comprise two types of contacts, wherein one type contacts comprise four first elastic contacts 201, and another type contacts comprise five first flat contacts 202. The first elastic contacts 201 are adapted for USB protocol and an arrangement of the first elastic contacts 201 is compatible to a standard USB A type plug. Each first elastic contacts 201 has an elastic contact portion 2010 extending to a lower side of the first tongue 102, a securing portion 2011 engaging with the third passageways 1025, and a soldering portion 2012 extending out of the insulative housing 1. The elastic contact portions 2010 are cantilevered and accommodated in the third passageways 1025 and protrude beyond the lower face 1022, so that the elastic contact portion 2010 is deformable along the thickness direction.

The second contacts 202 comprise two pairs of differential signal contacts 2020 and a grounding contact 2021. The two pairs of differential signal contacts 2020 are used for transferring/receiving high-speed signals, and the grounding contact 2021 is disposed between the two pairs of differential signal contacts 2020 for preventing cross-talk. Each differential contact 2020 of each pair has a first flat contact portion 2022 extending to a lower side of the first tongue 102, a first connecting portion 2023 extending upwardly from a front end of the first flat contact portion 2022, a first retention portion 2023 extending backwardly from the first connecting portion 2023, and a first tail portion 2025 extending from the connecting portion 2023. The grounding contact 2021 is of the same configuration as the differential contact 2020. So the grounding contact 2021 comprises a second flat contact portion 2026, a second connecting portion 2027 extending upwardly from a front end of the second flat contact portion 2026, a second retention portion 2028 extending backwardly from the second connecting portion 2027 and a second tail portion 2025 located between the first tail portions 2029 of each pair.

When the differential signal contacts 2020 are inserted into first mating interface, the retention portions 2024, 2028 are fixed in the first passageways 1023, and the connecting portions 2023, 2027 cover a front end of the first tongue 102, and the flat contact portions 2022, 2026 are received in the second passageways 1024 and juxtaposed with each other in the width direction. The flat contact portions 2022, 2026 and the retention portion 2024, 2028 are parallel to each other wherein the flat contact portions 2022, 2026 are much shorter than the retention portions 2024, 2028. The flat contact portions 2022, 2026 are perpendicular to the tail portions 2025, 2029.

Meanwhile, the flat contact portions 2022, 2026 are located forward the elastic contact portions 2010 of the elastic contacts 201. The flat contact portions 2022, 2026 are arranged at a front row, while the elastic contact portions 2010 are arranged at a rear row. Because the second and third passageways 1024, 1025 are discontinuous in the front-to-back direction, the flat contact portions 2022, 2026 and the elastic contact portions 2010 will not contact with each other and have a distance therebetween for preventing two types signal transmission from confusing. The flat and elastic contact portions 2022, 2026 and 2010 are arranged at a same side of the upper face 1021 and located at different rows for employing the space of the lower face 1022 adequately, and decreasing the crosstalk between adjacent contacts 2.

In addition, the contact portions 2010, 2022 and 2026 are located at different plane along the thickness direction of the first tongue 102, wherein the elastic contact portions 2010 are elastic and protrude beyond the lower face 1022, while the flat contact portions 2022, 2026 are received in the second passageways 1024, for connecting with two different plug (not shown) conveniently. When a USB 2.0 A type plug (not shown) inserts into the first receiving space 101, the plug will electrically connect with the elastic contact portions 2010, and not contact the flat contact portions 2022, 2026. When another plug (not shown) inserts into the first receiving space 101, it will contact with two different contact portions 2010, 2022 and 2026 effectively for ensuring the signal transmission.

The second contacts 21 are inserted into the second mating interface from a rear end of the second housing 11. Each second contact 21 has a fixing portion 210 retained in the base portion 114, a mating portion 211 extending into the second receiving space 112, and a soldering tail 212 bending downwardly from the fixing portion 210. The mating portions 211 are all received in the contact passageways 1133 of the upper face 1131. The spacer 4 is assembled in a lower position of the second housing 11. A plurality of holes 41 extend through the spacer 4 for fixing the second contacts 21.

The metal shield 3 comprises a front shield 30 covering a front face and two sides of the insulative housing 1, a rear shield 31 covering a top face and the rear end of the insulative housing 1, and two first inner shields 32 retained in the first receiving space 101, and a second inner shield 33 retained in the second receiving space 112.

The front shield 30 has a front wall 300 and two side walls 301. The front wall 200 defines a plurality of openings 302 corresponding to each mating interface. Each side wall 301 has a number of first spring arms 303 extending forwardly, and a plurality of cutouts 304 at a rear position thereof. A pair of mounting legs 305 extend downwardly from each side wall 301. The rear shield 31 has a top wall 310 and a rear wall 311. A pair of latches 312 extend forwardly from each side of the rear wall 311 for locking with the cutouts 304.

The first inner shield 32 encloses the first tongue 102, and comprises a plurality of second spring arms 320 extending inwardly from each wall thereof for engaging with the plug, and two flanges 321 extending outwardly from a front end thereof for engaging with the front shield 30 for grounding. When the plug inserts into the first receiving space 101, the plug abuts against the second spring arms 320. The second spring arms 320 move outwardly and through the openings 1061 for contacting with the first spring arms 303 for grounding. The second inner shield 33 is assembled in the second receiving space 112 along the apertures 1110 and encloses the second tongue 113. The second shield 33 comprises two locking holes 330 locking with the protrusions 1111 of the second housing 11, and a pair of third spring arms 331 at upper and lower walls thereof for abutting against a corresponding plug (not shown). A pair of flanges 332 extend outwardly from a front end of the second inner shield 33 to contact with the front shield 30 for grounding.

As fully described above, the stacked electrical connector 100 of the present invention in the first embodiment adds two pairs of differential signal contacts 2020 and a grounding contact 2021 relative to the standard USB 2.0 connector as stacked with a Serial ATA connector. Thereby, the stacked electrical connector 100 has a simple structure, and the speed of signal transmission is increased as adding the two pairs differential signal contacts 2020, which is adapted to the trend of development of the electrical industry.

Figure 6:
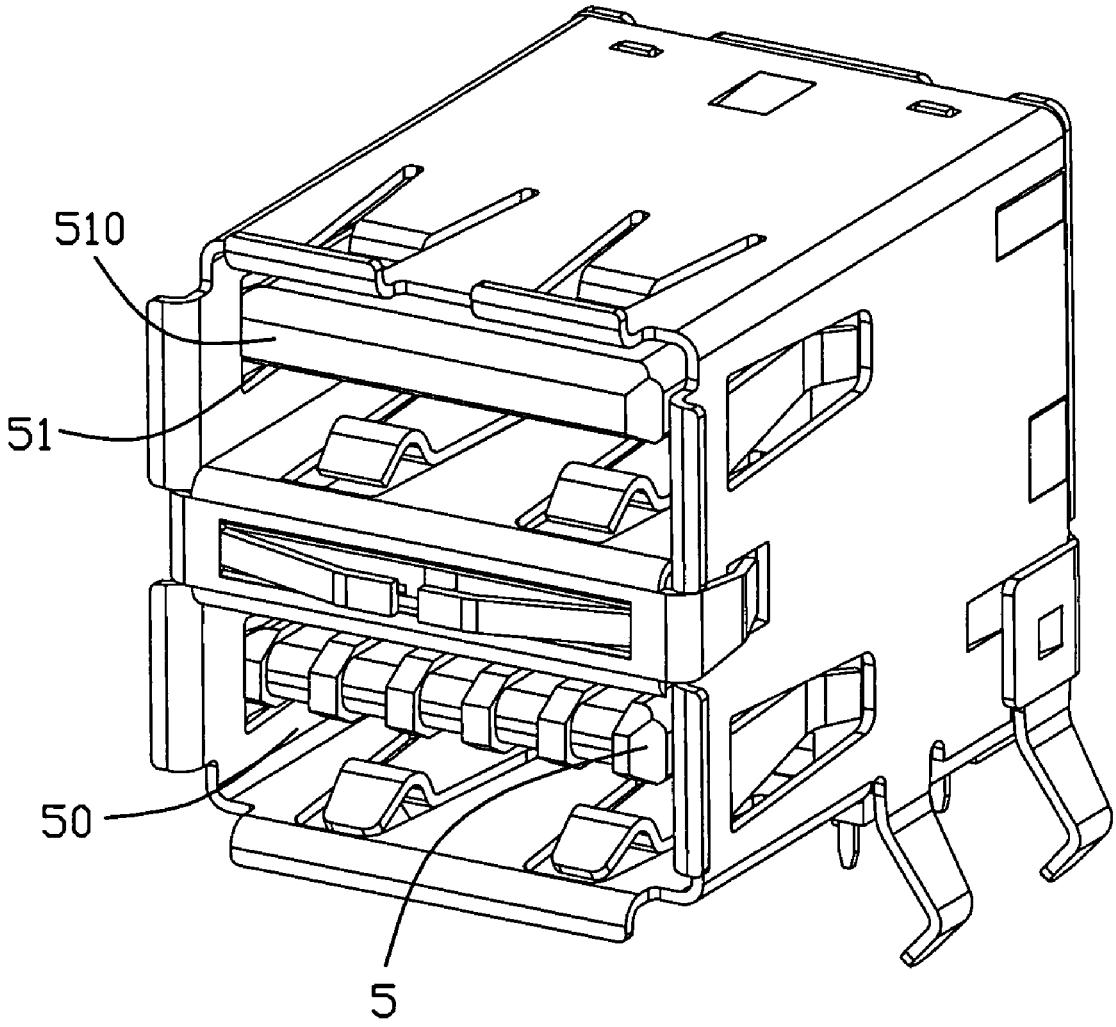
FIG. 6 is a perspective view of an stacked electrical connector according to a second embodiment of the present invention.
Figure 7:
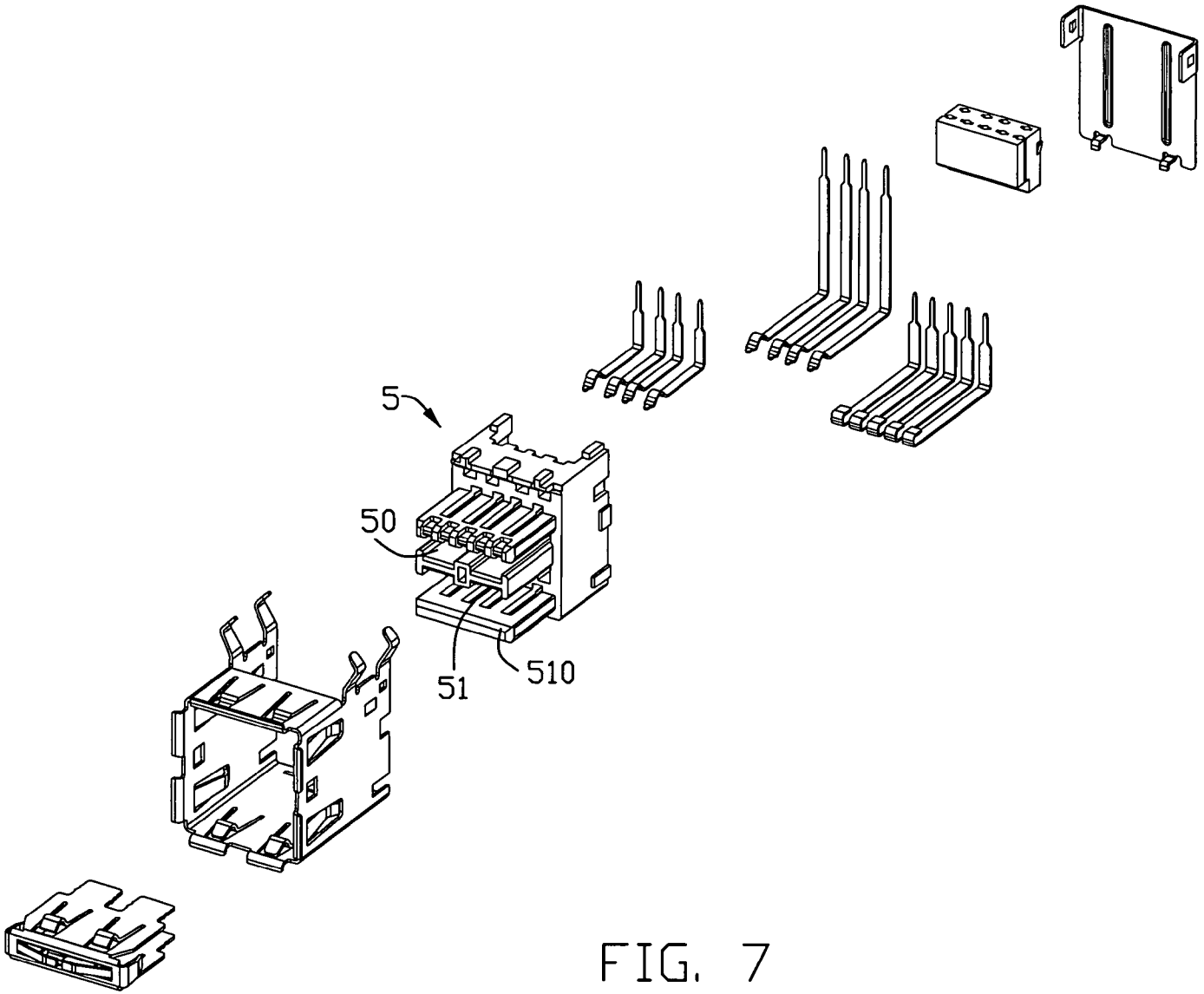
FIG. 7 is an exploded view of the stacked electrical connector shown in FIG. 6.

Referring to FIGS. 6 and 7, a stacked electrical connector according to a second embodiment of the present invention is disclosed. The difference between the stacked electrical connectors of the first and second embodiments is that first, an insulative housing 5 is molded integrally; second, there is only a first mating interface 50 which is similar to the first mating interface in the first embodiment; third, the second mating interface 51 is a standard USB 2.0 A type interface. The second mating interface 51 has a second tongue 510. Four USB 2.0 contacts extend to a lower side of the second tongue 510 for electrically connect with a USB 2.0 A type plug (not shown). The second mating interface 51 is located at top of the first mating interface 50.

Figure 8:
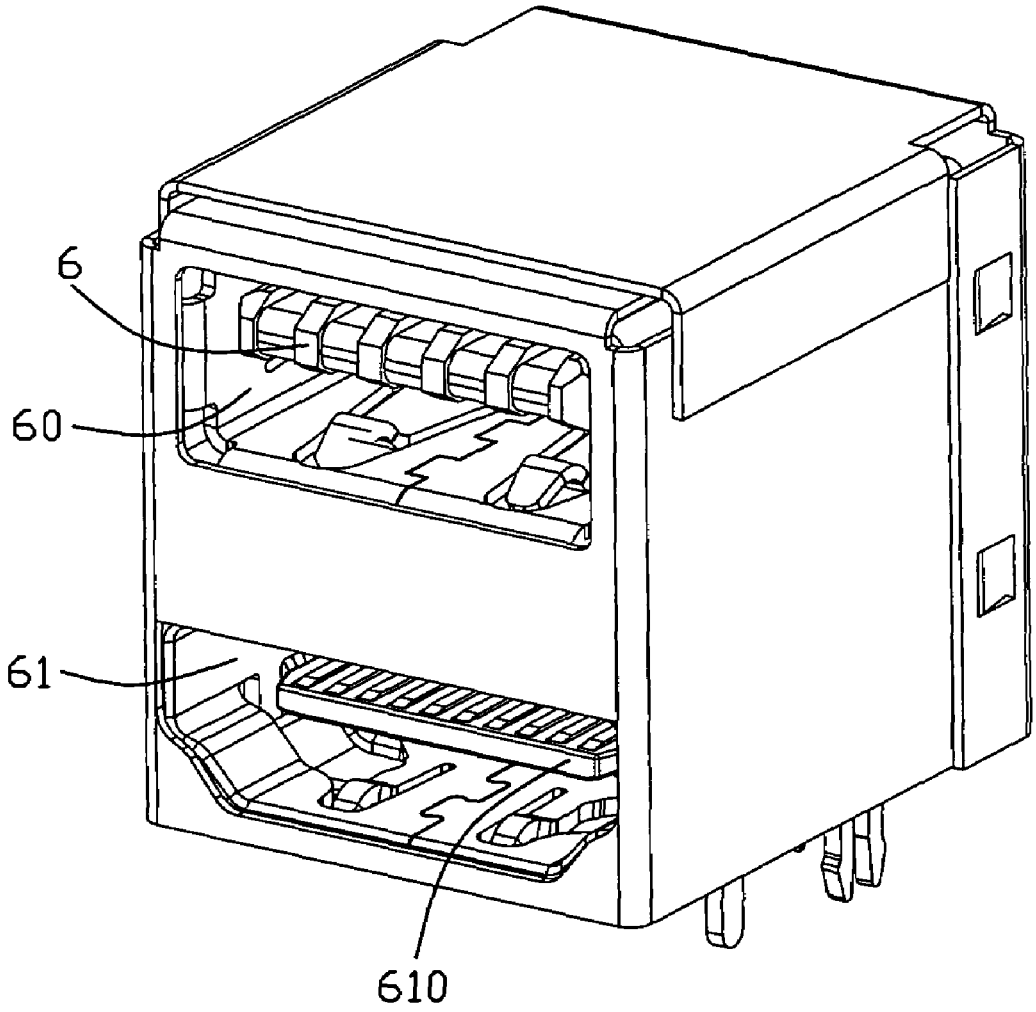
FIG. 8 is a perspective view of an stacked electrical connector according to a third embodiment of the present invention.
Figure 9:
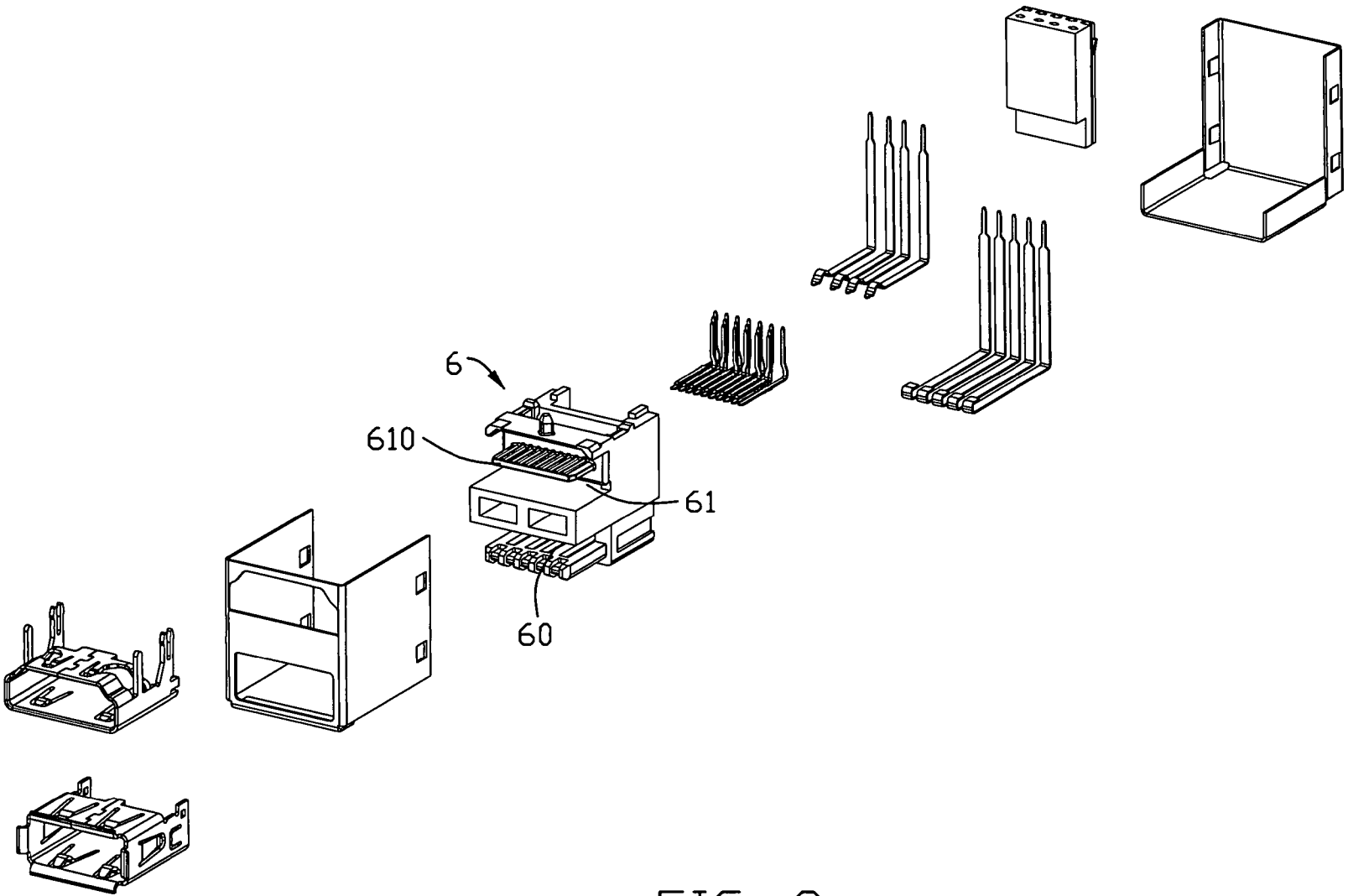
FIG. 9 is an exploded view of the stacked electrical connector shown in FIG. 8.

Referring to FIGS. 8 and 9, an stacked electrical connector according to a third embodiment of the present invention is disclosed. The difference between the stacked electrical connectors of the first and third embodiments is that first, an insulative housing 6 is molded integrally; second, there is only a first mating interface 60 which is similar to the first mating interface in the first embodiment; third, the second mating interface 61 is a standard High Digital Multimedia Interface (HDMI). The second mating interface 61 has a D-shaped receiving space and a second tongue 610 received therein. A plurality of flat contacts extend to two sides of the second tongue 610 for electrically contacting with a HDMI plug (not shown).

Figure 10:
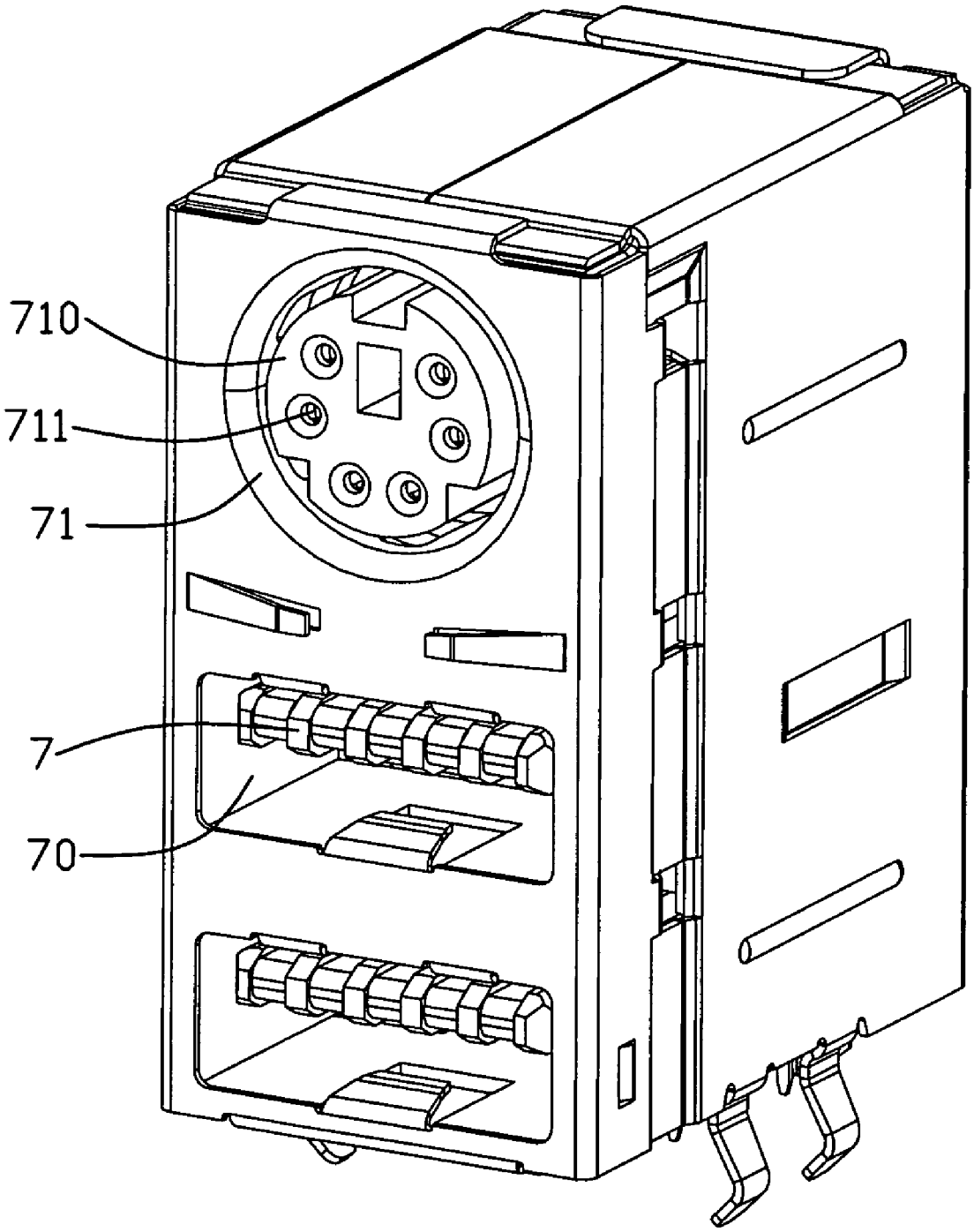
FIG. 10 is a perspective view of an stacked electrical connector according to a fourth embodiment of the present invention.

Referring to FIG. 10, an stacked electrical connector according to a fourth embodiment of the present invention is disclosed. The difference between the stacked electrical connectors of the first and fourth embodiments is that: first, a second mating interface 71 is located at an upper position of an insulative housing 7, while a first mating interface 70 which is similar to that of the first embodiment is located at a lower position of the insulative housing 7; second, the second mating interface 71 is a standard DIN connector. The second mating interface 71 comprises an annular recess with a cylindrical portion 710 received therein. The cylindrical portion 710 defines a plurality of passageways 711 extending through the insulative housing 7. A plurality of DIN contacts extend to the passageways 711.

Figure 11:
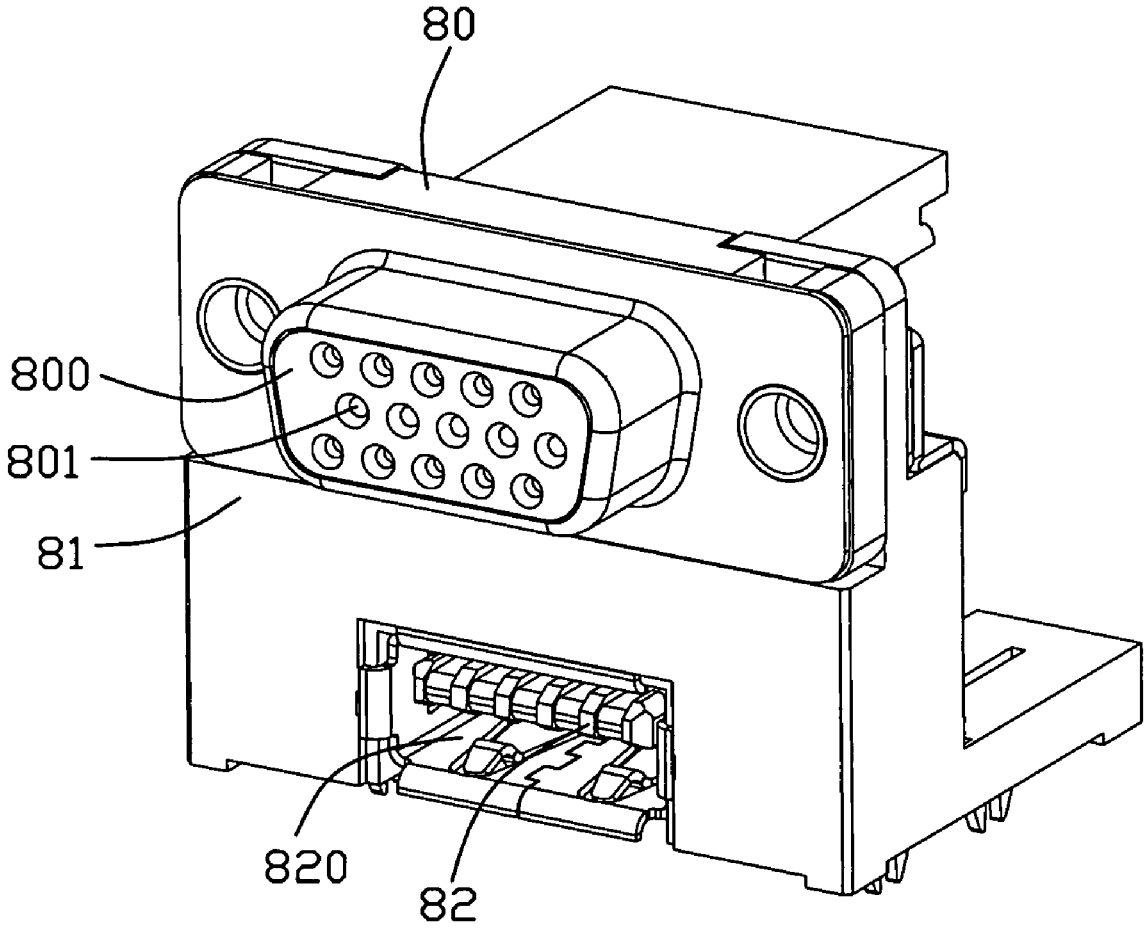
FIG. 11 is a perspective view of an stacked electrical connector according to a fifth embodiment of the present invention.
Figure 12:
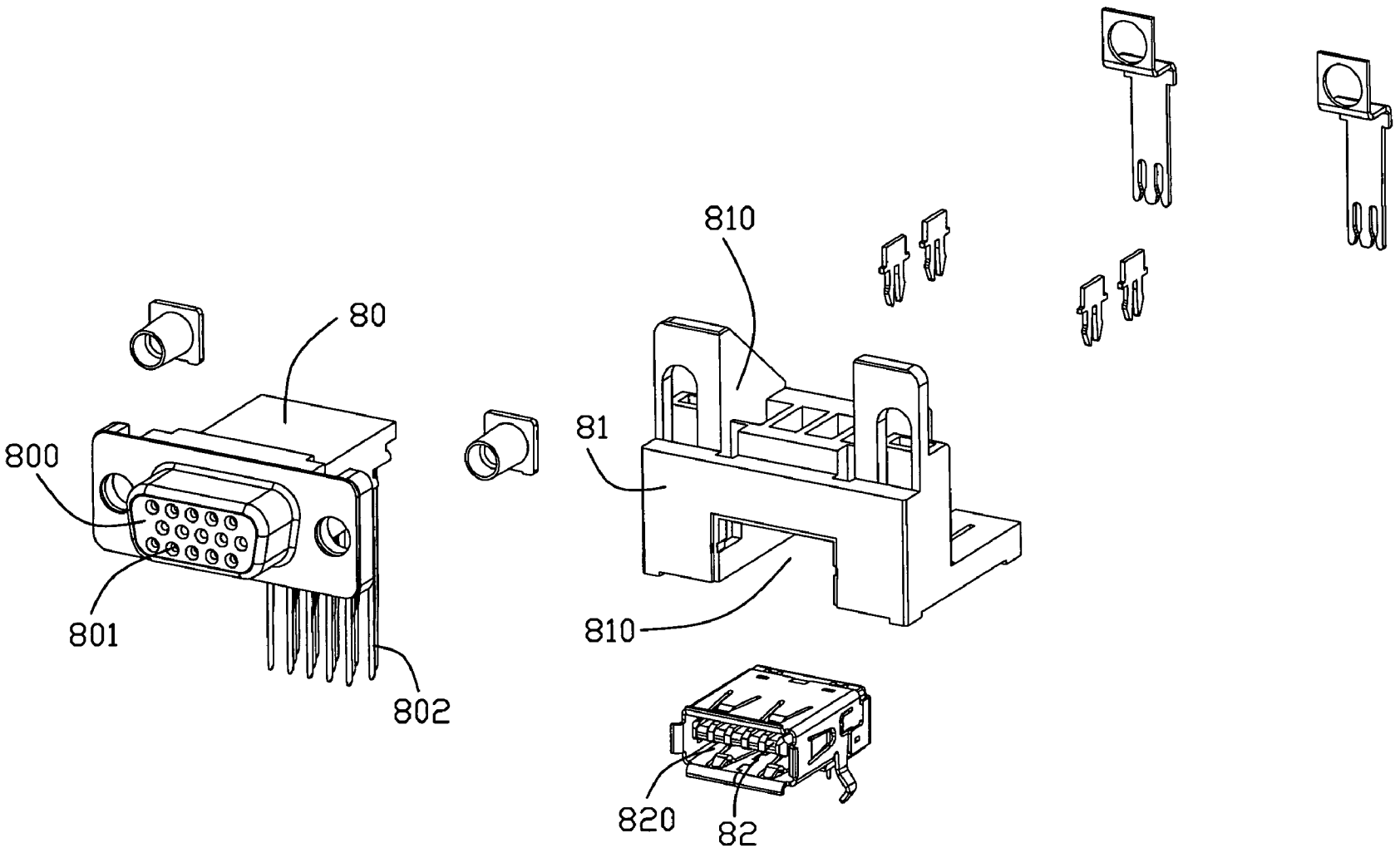
FIG. 12 is an exploded view of the stacked electrical connector shown in FIG. 11.

Referring to FIGS. 11 and 12, an stacked electrical connector according to a fifth embodiment of the present invention is disclosed. The difference between the stacked electrical connectors of the first and fifth embodiments is that an insulative housing 8 comprises a frame 81, a first housing 80 and a second housing 82 fixed to the frame 81. The frame 81 defines a pair of upper and lower space 810 for receiving the first and second housing 80, 82 respectively. The second housing 82 comprises a first mating interface 820 which is similar to that of the first embodiment. While the first housing 80 comprises a second mating interface 800 protruding forwardly and presenting as D shape. The second mating interface 800 is a standard D-SUB interface. Each first and second mating interface 820, 800 has a mating face mating with a corresponding plug (not shown). The mating faces of the first and second mating interface 820, 800 are arranged in an offset manner in both length direction and the thickness direction. In addition, the second mating interface 800 defines a plurality of passageways 801 for receiving D-SUB contacts 802.

Figure 13:
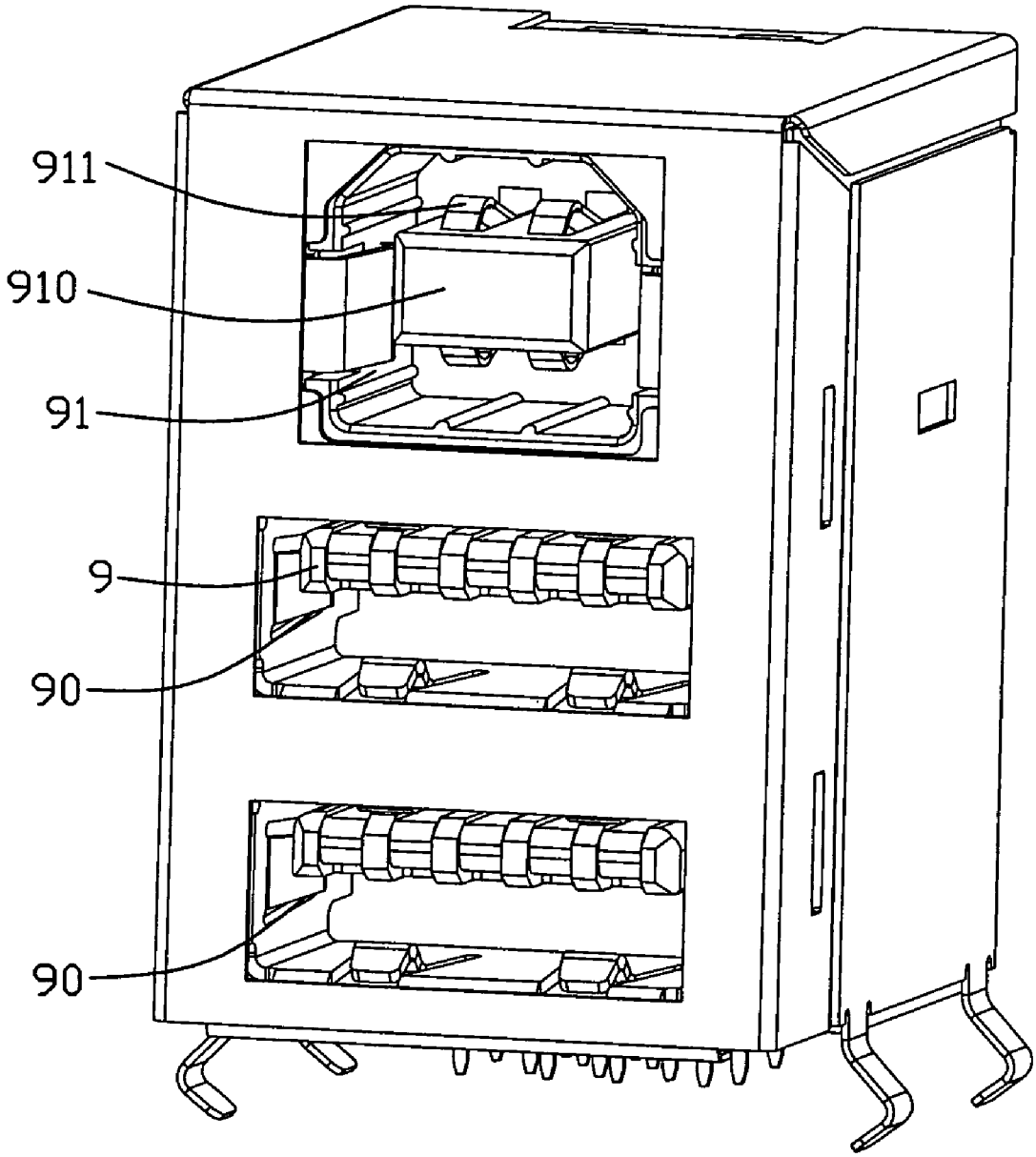
FIG. 13 is a perspective view of an stacked electrical connector according to a sixth embodiment of the present invention.

Referring to FIG. 13, an stacked electrical connector according to a sixth embodiment of the present invention is disclosed. The difference between the stacked electrical connectors of the first and sixth embodiments is that: first, a first mating interface 90 which is similar to that of the first embodiment is located at a lower position of an insulative housing 9, while a second mating interface 91 is located at an upper position; second, the second mating interface 91 is a standard USB B type interface. The second mating interface 91 comprises a second tongue 910. Two pairs of second elastic contacts 911 extend to upper and lower faces of the second tongue 910 respectively.

Figure 14:
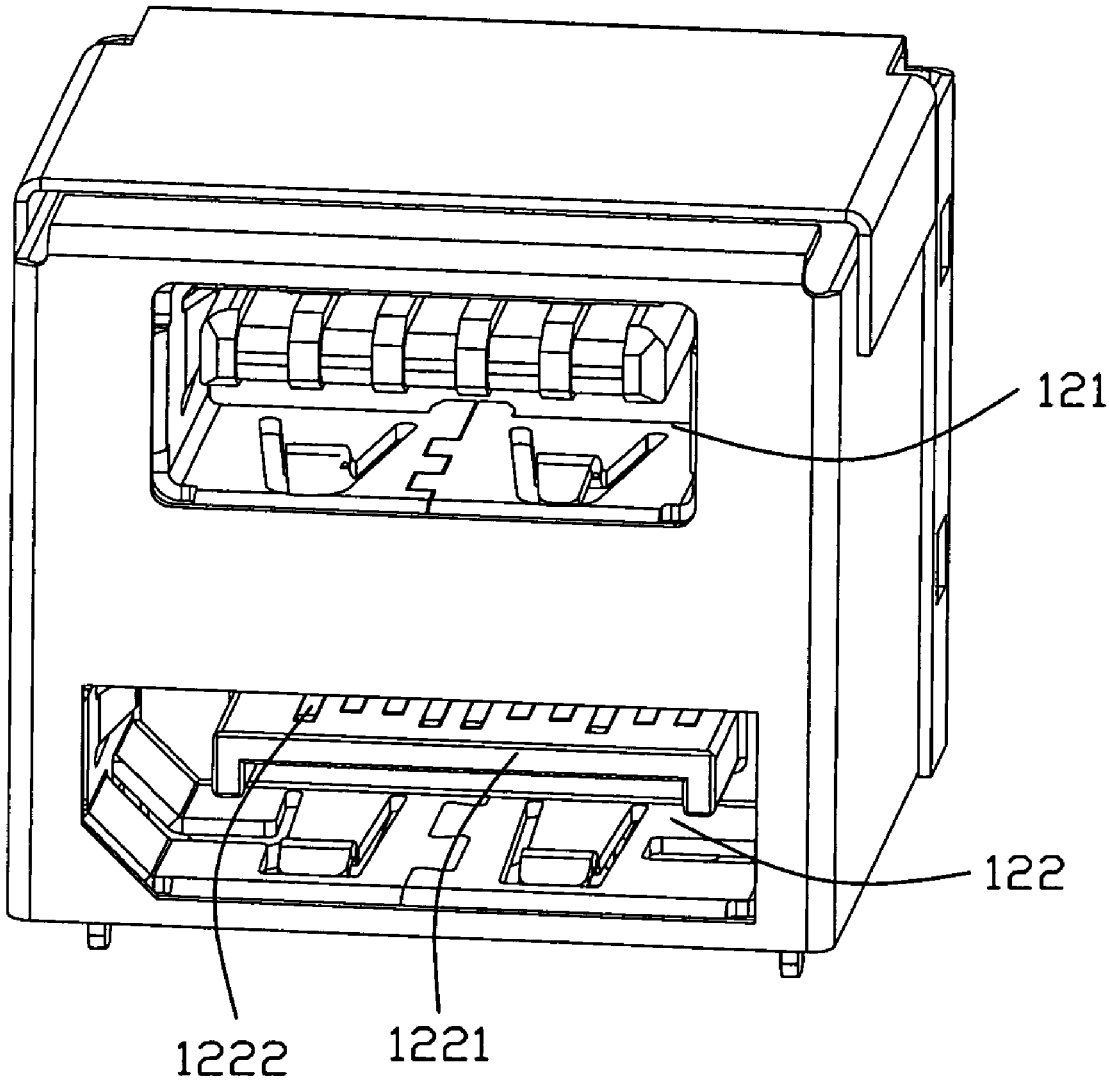
FIG. 14 is a perspective view of an stacked electrical connector according to a seventh embodiment of the present invention.

Referring to FIG. 14, an stacked electrical connector according to a seventh embodiment of the present invention is disclosed. The difference between the stacked electrical connectors of the first and seventh embodiments is that a second mating interface 122 is a standard Displayport interface. A second tongue 1221 of the second mating interface 122 presents as a reverse U shape. A plurality of second contacts 1222 extend to an upper face and a lower face of the second tongue 1221 for electrically connecting with a standard Displayport plug (not shown). There is only a first mating interface 121 which is similar to that of the first embodiment stacked with the second mating interface 122 at an upper position.

Figure 15:
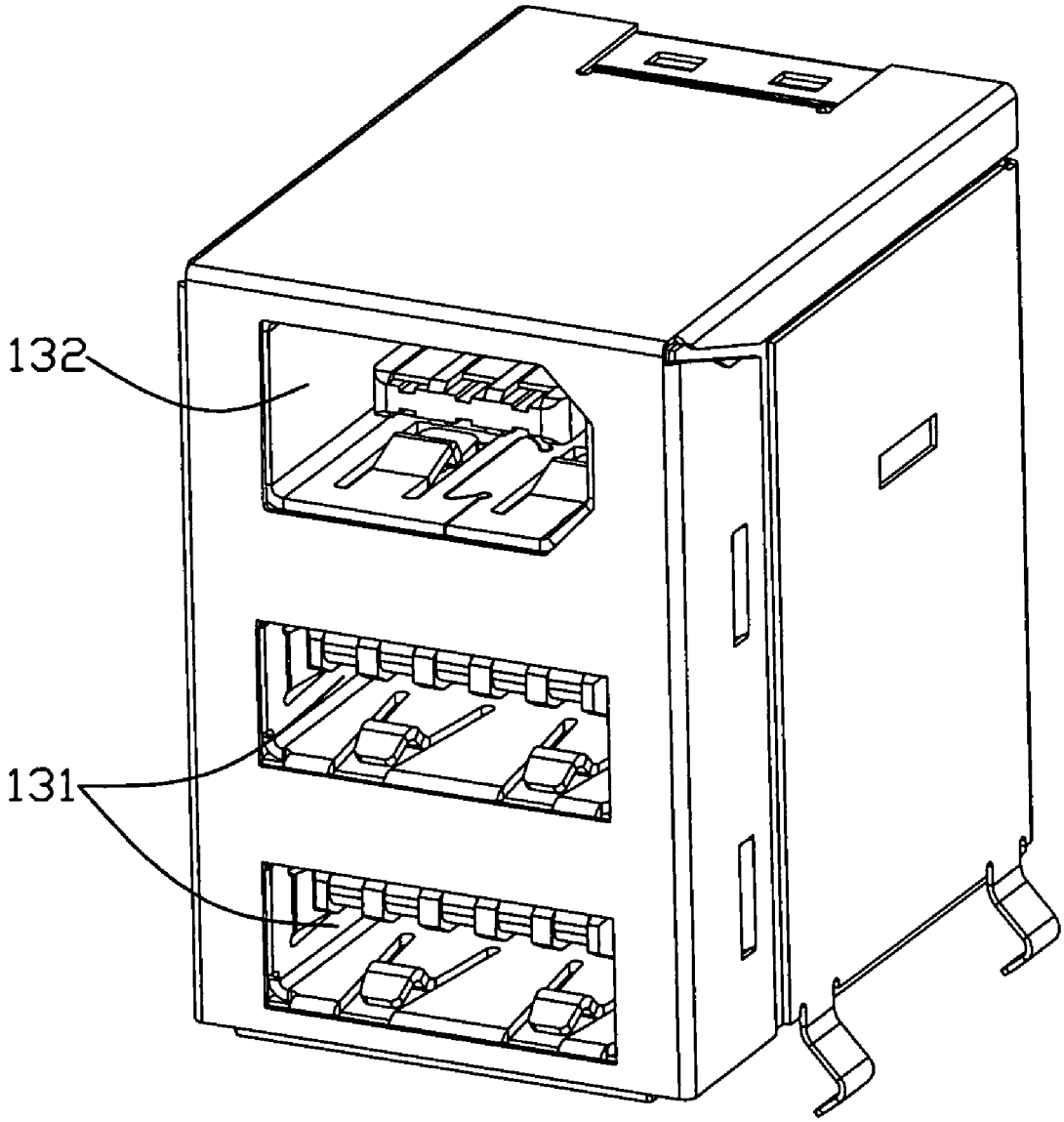
FIG. 15 is a perspective view of an stacked electrical connector according to a eighth embodiment of the present invention.
Figure 16:
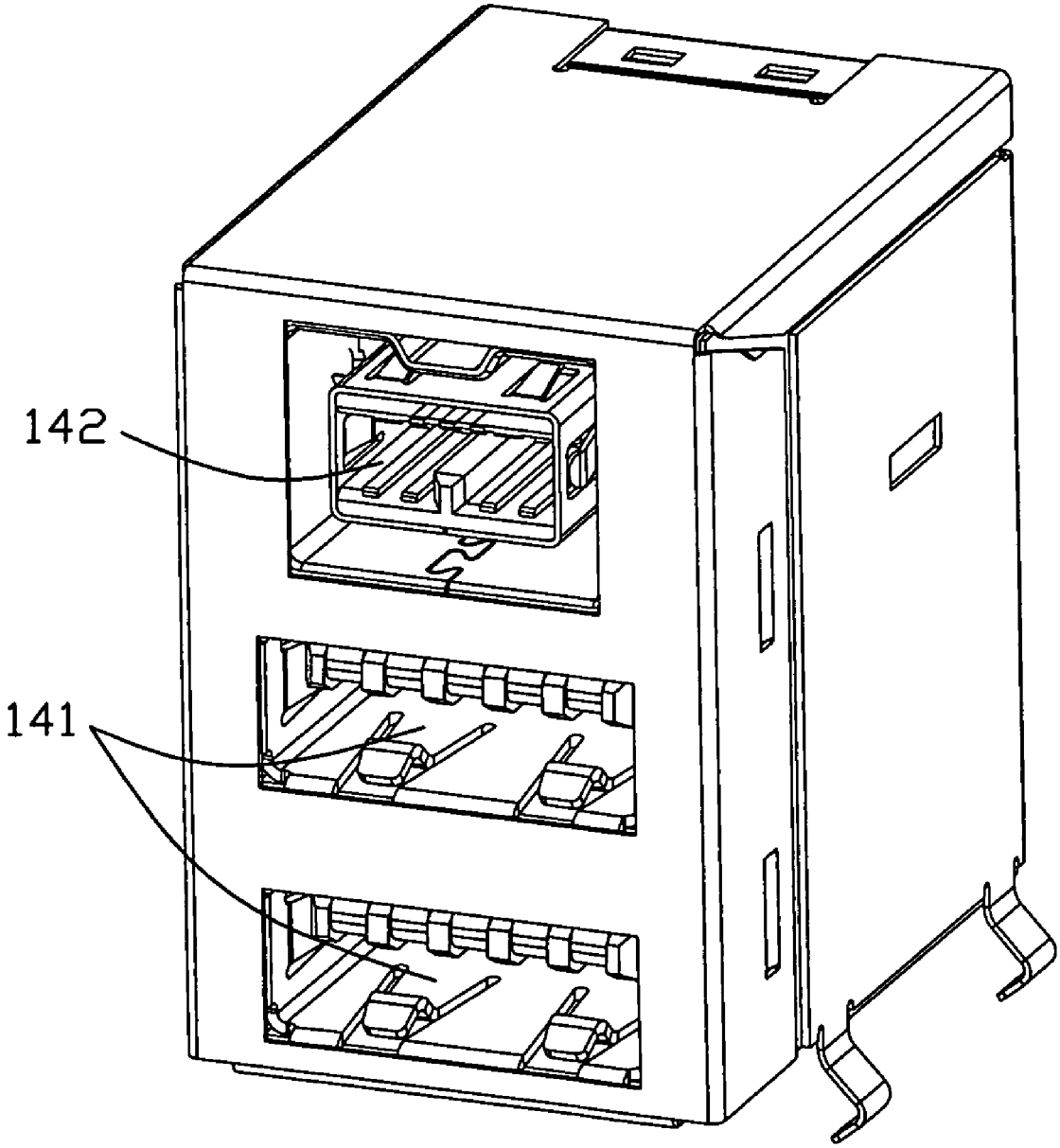
FIG. 16 is a perspective view of an stacked electrical connector according to a ninth embodiment of the present invention.

Referring to FIG. 15, an stacked electrical connector according to a eighth embodiment of the present invention is disclosed. The difference between the stacked electrical connectors of the first and eighth embodiments is that a second mating interface 132 is a standard IEEE 1394 A type interface. There are two first mating interfaces 131 stacked with the second mating interface 132 and located at a lower position. And referring to FIG. 16, a second mating interface 142 in a ninth embodiment is a standard IEEE 1394 B type interface. And there are two first mating interfaces 141 stacked with the second mating interface 142 and located at a lower position.

Figure 17:
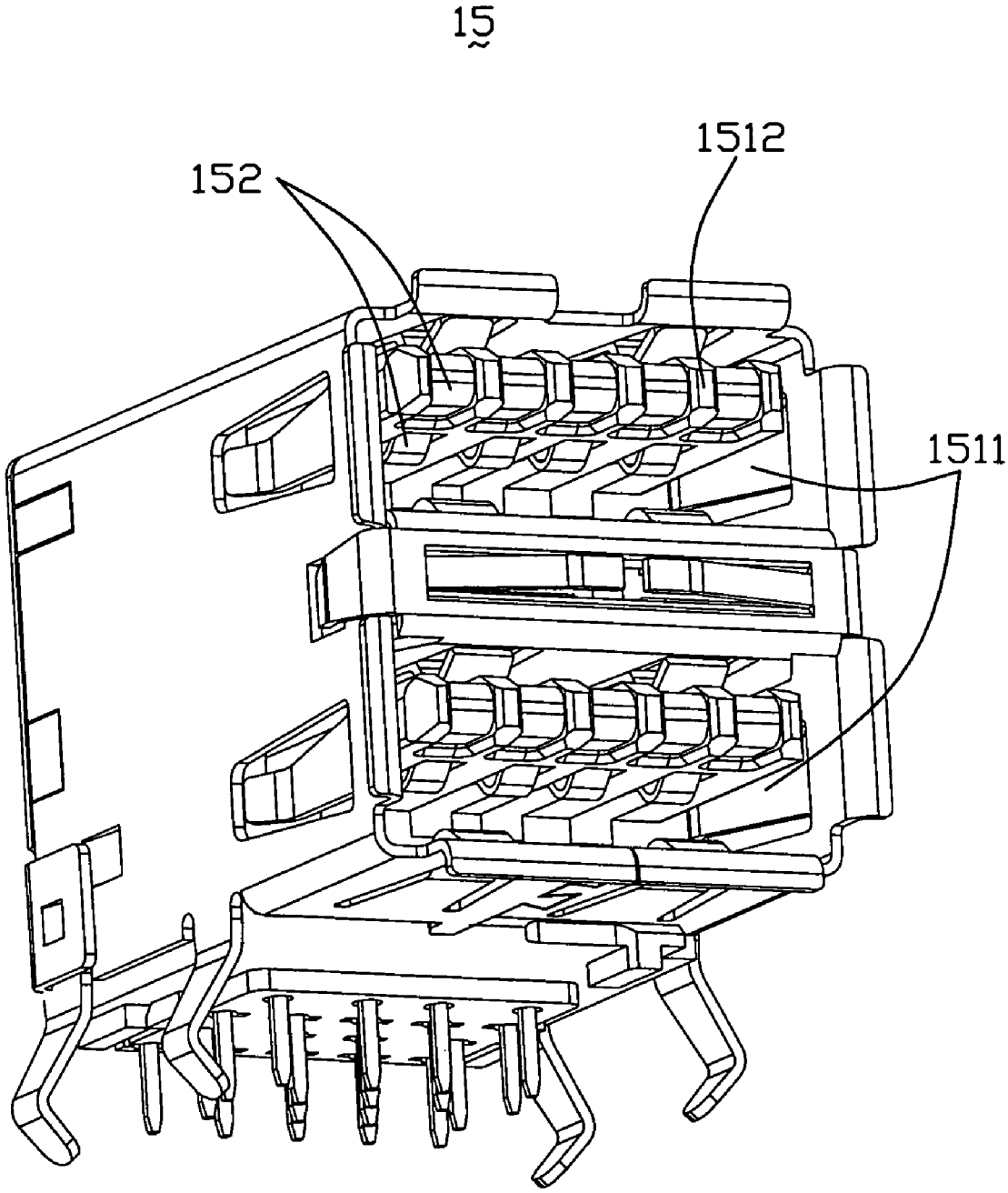
FIG. 17 is a perspective view of an stacked electrical connector according to a tenth embodiment of the present invention.
Figure 18:
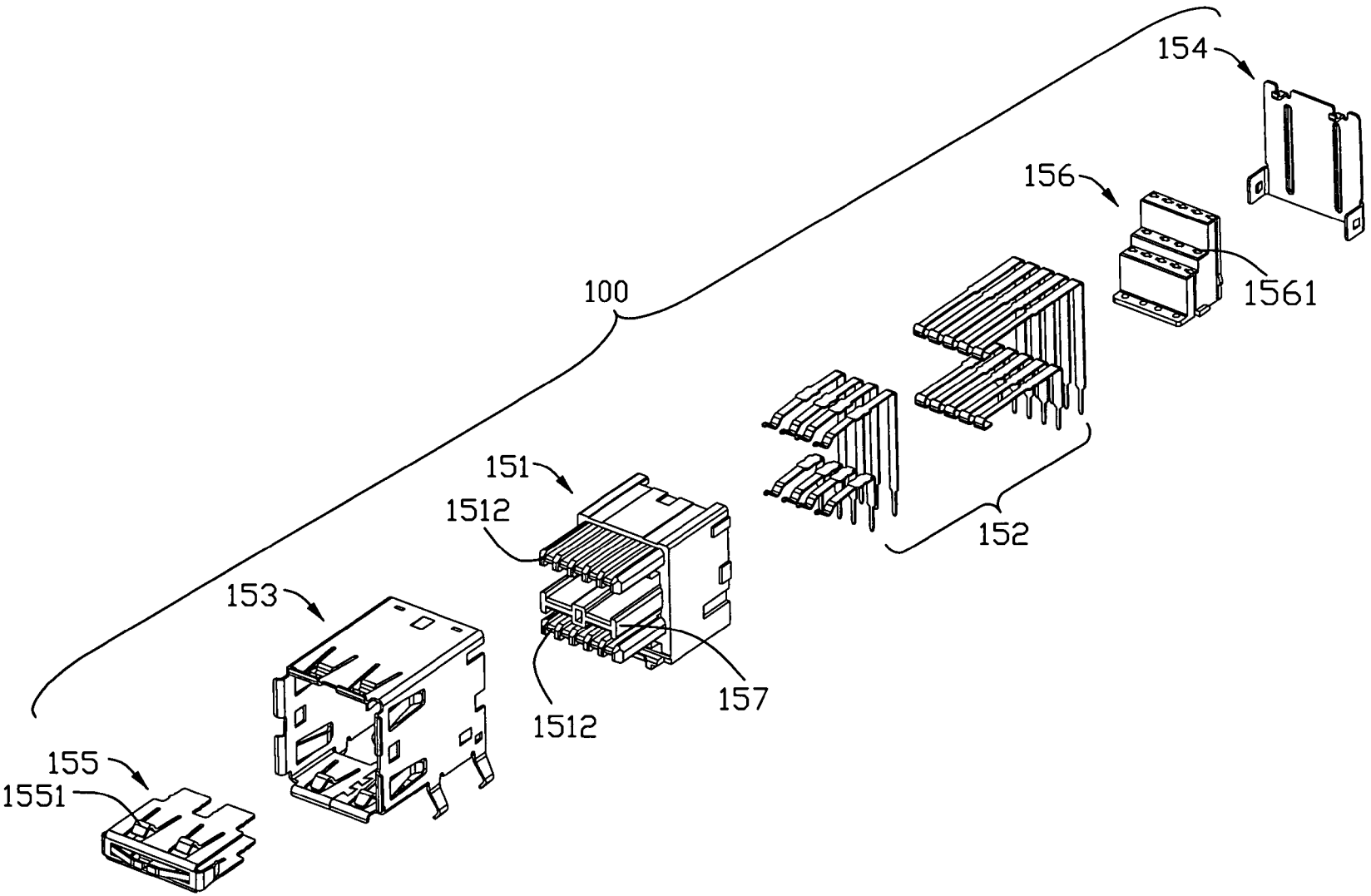
FIG. 18 is an exploded view of the stacked electrical connector shown in FIG. 17.

Referring to FIGS. 17 and 18, an stacked electrical connector 15 according to tenth embodiment of the present invention is disclosed. In the tenth embodiment, the stacked electrical connector 15 comprises an insulative housing 151, two groups of contacts 152 which are similar to the first contacts 20 of the first embodiment retained in the insulative housing 151, an outer shield 153 enclosing the insulative housing 151, a rear shield 154 covering a rear end of the insulative housing 151, an inner shield 155 retained in the insulative housing 151 and a spacer 156 for fixing the contacts 152. There are two stacked mating interfaces 1511 which are all similar to the first mating interface of the first embodiment and integrally molded in the insulative housing 151. A clapboard 157 extends forwardly between two mating interfaces 1511. Each mating interface 1511 comprises a tongue plate 1512 extending forwardly and parallel to the clapboard 157. Each group contacts 152 have same structure with the first contact 20, and are arranged on each tongue plate 1512 same as the arrangement of the first contact 20. The spacer 156 defines a plurality of holes 1561 for receiving a lower portion of each contact 152. The inner shield 155 encloses the clapboard 157 and locking with the outer shield 153. The inner shield 155 comprises two pairs of spring arms 1551 extending into each mating interface 1511 for engaging with a corresponding plug (not shown).

Figure 19:
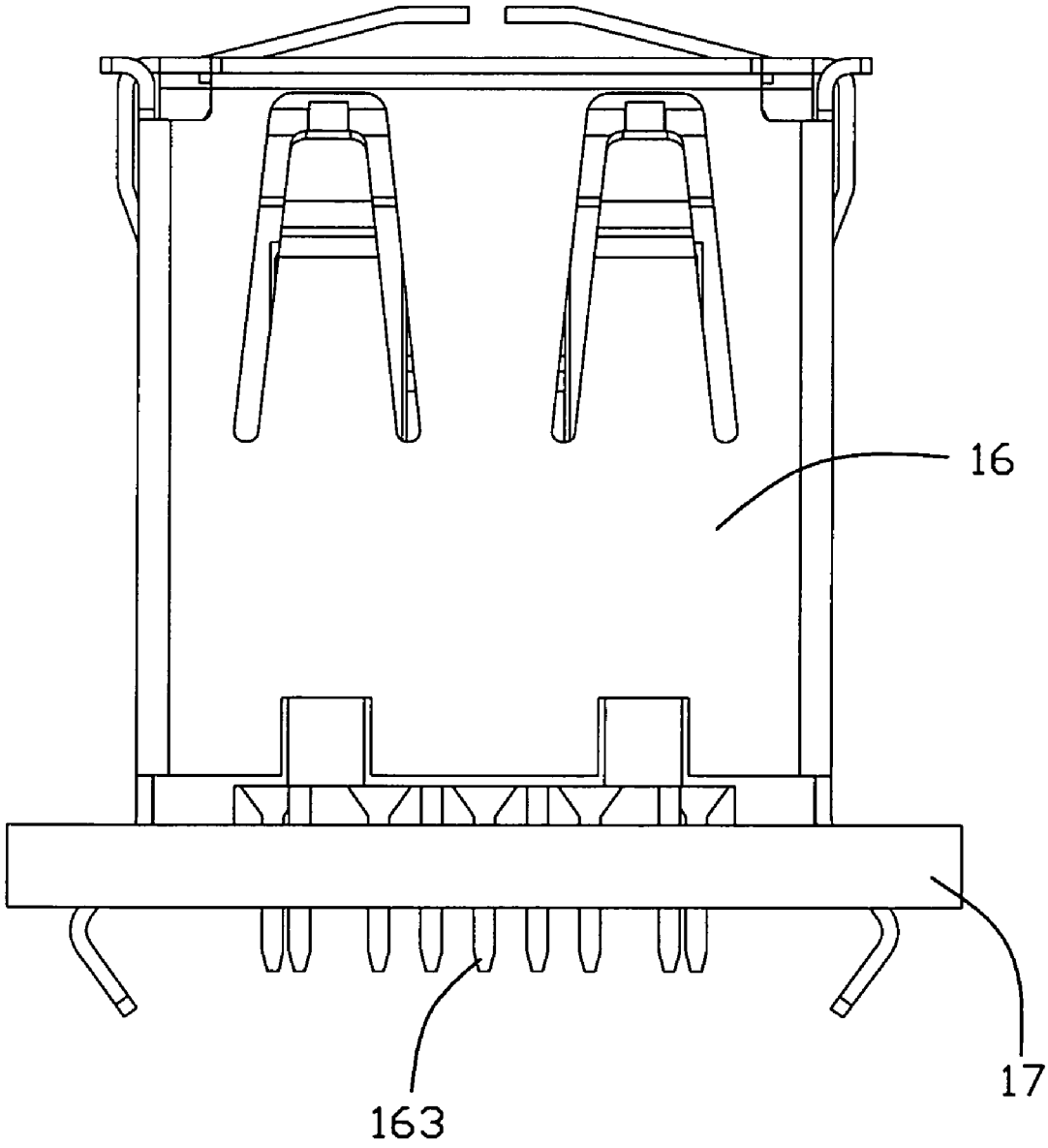
FIG. 19 is a front elevational view of an stacked electrical connector according to a eleventh embodiment of the present invention.
Figure 20:
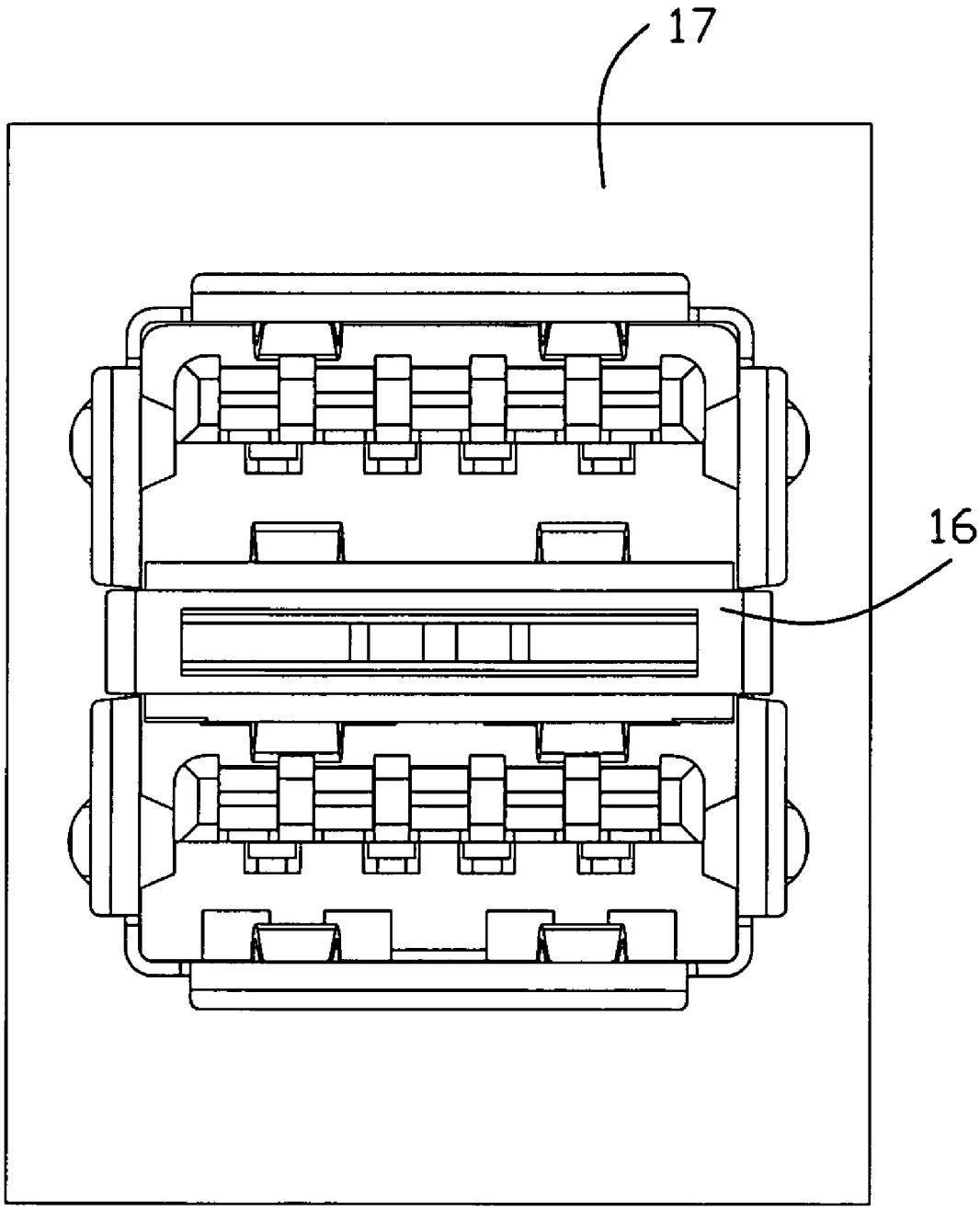
FIG. 20 is a top plan view of the stacked electrical connector shown in FIG. 19.
Figure 21:
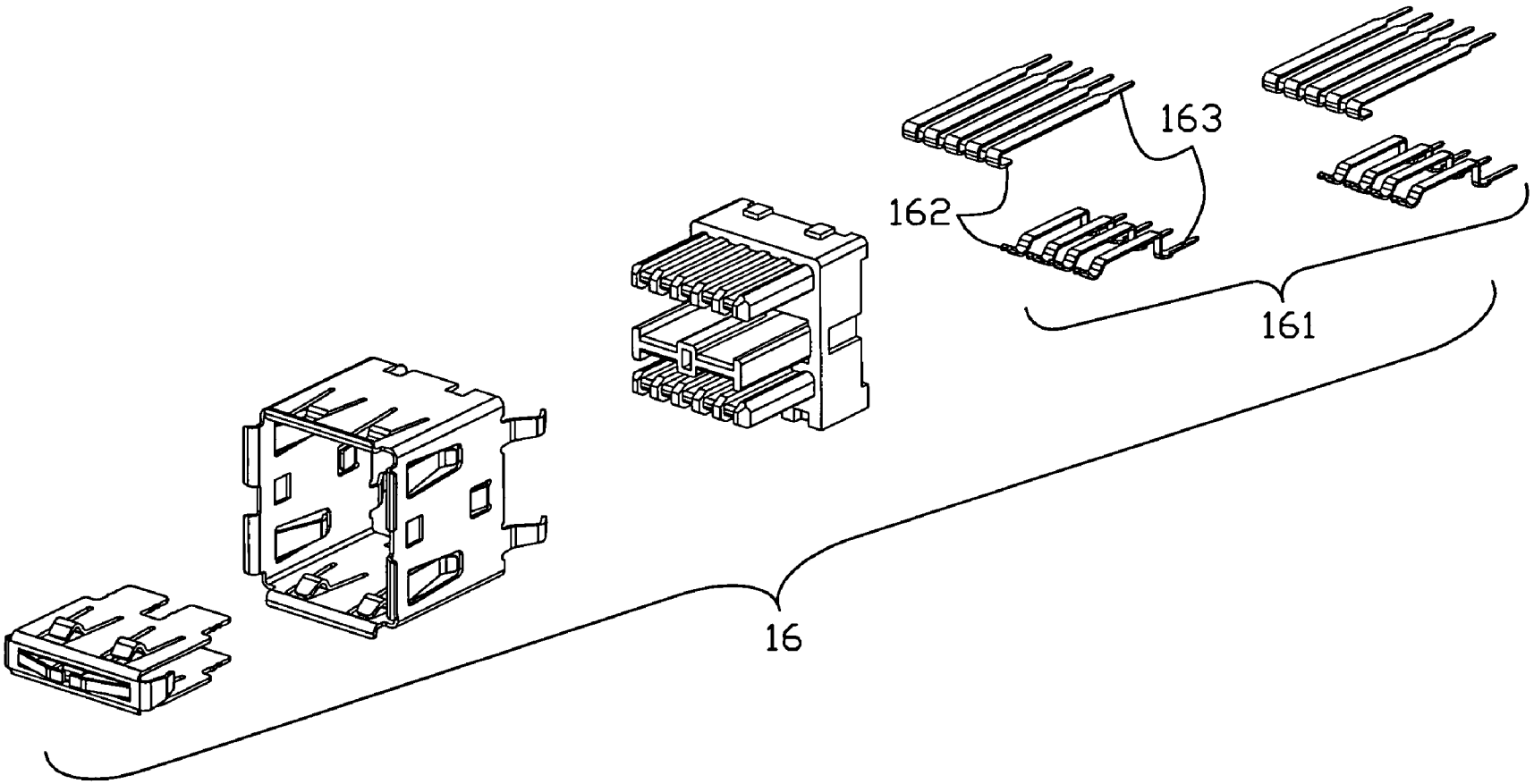
FIG. 21 is an exploded view of the stacked electrical connector shown in FIG. 19.

Referring to FIGS. 19-21, an stacked electrical connector 16 according to eleventh embodiment of the present invention is disclosed. The stacked electrical connector 16 is approximately same as the stacked electrical connector 15 in the tenth embodiment. The difference is that a soldering portion 163 of each contact 161 is parallel to a contact portion 162 thereof. The stacked electrical connector 16 is soldered to a circuit board 17 vertically.

Figure 22:
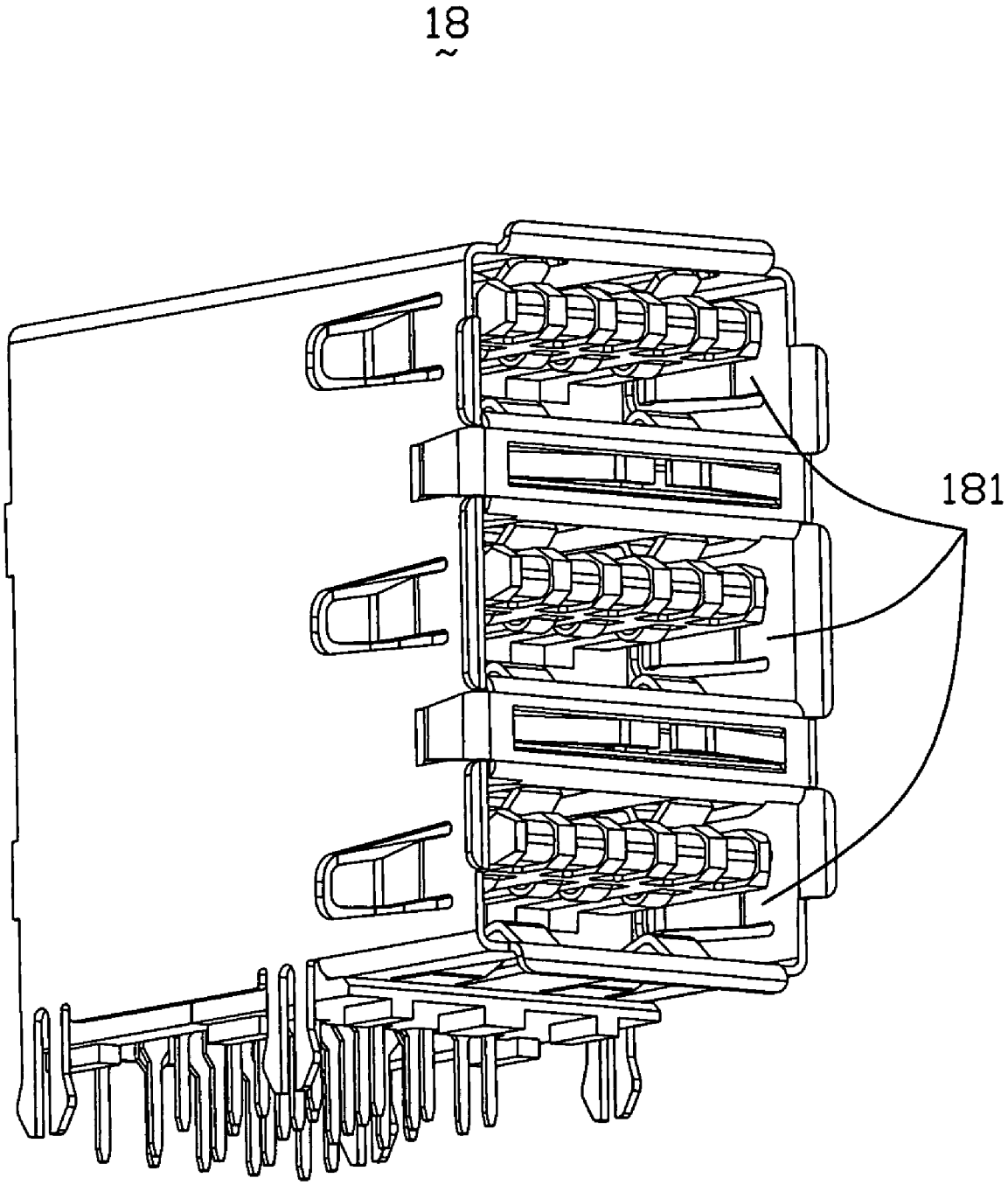
FIG. 22 is a perspective view of an stacked electrical connector according to a twelfth embodiment of the present invention.
Figure 23:
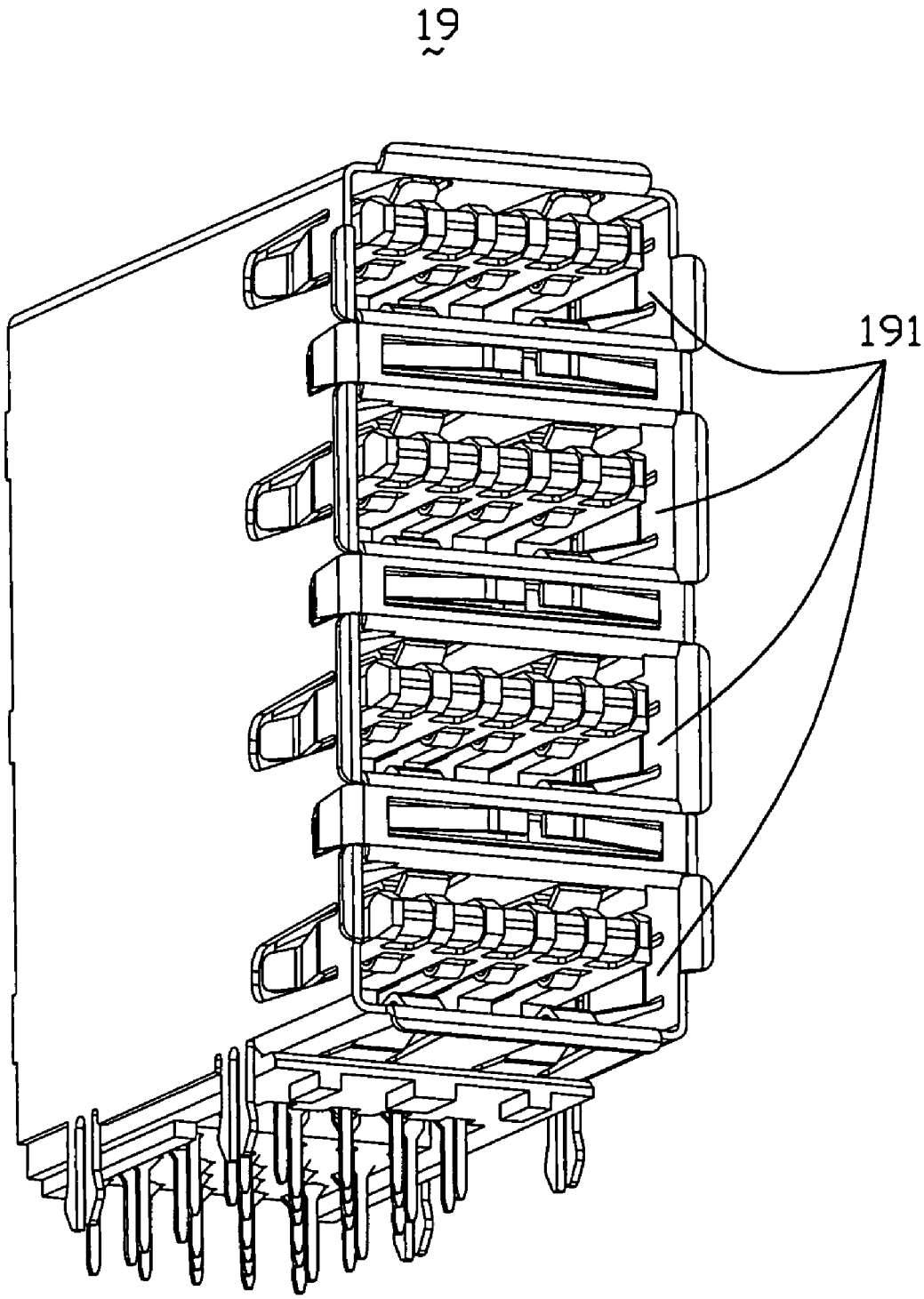
FIG. 23 is a perspective view of an stacked electrical connector according to a thirteenth embodiment of the present invention.
Figure 24:
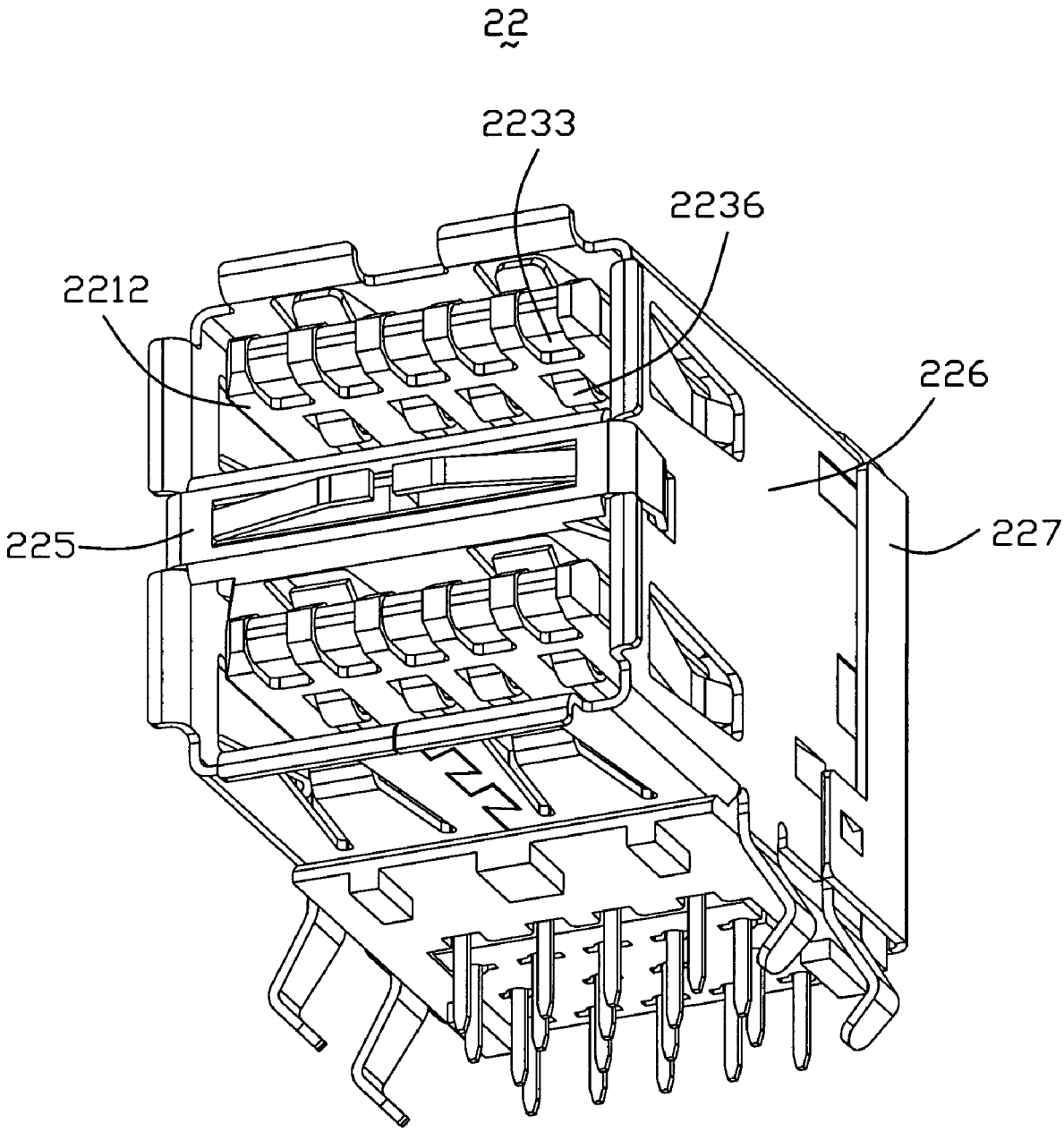
FIG. 24 is a perspective view of an stacked electrical connector according to a fourteenth embodiment of the present invention.
Figure 25:
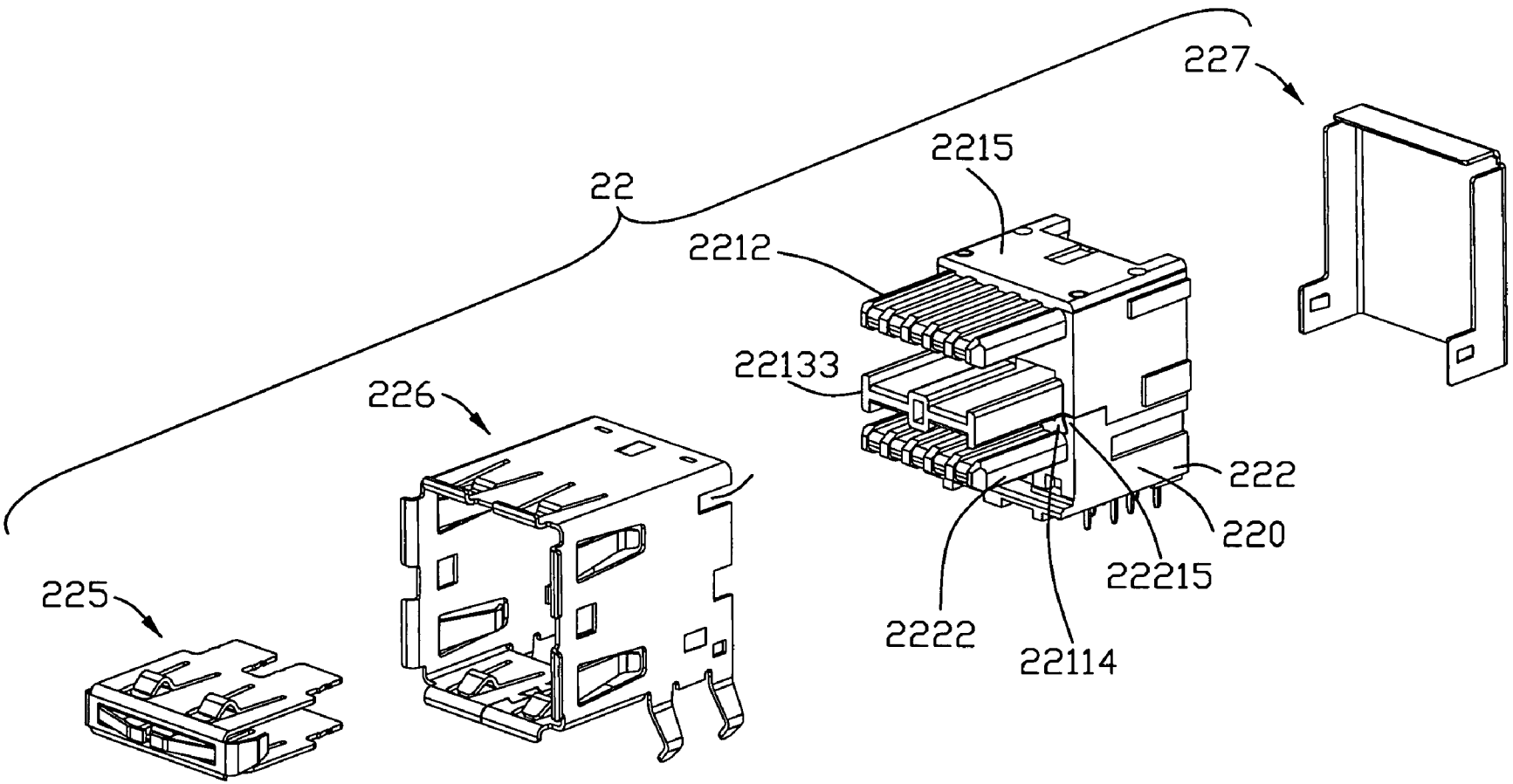
FIG. 25 is a partially exploded view of the stacked electrical connector shown in FIG. 24.
Figure 26:
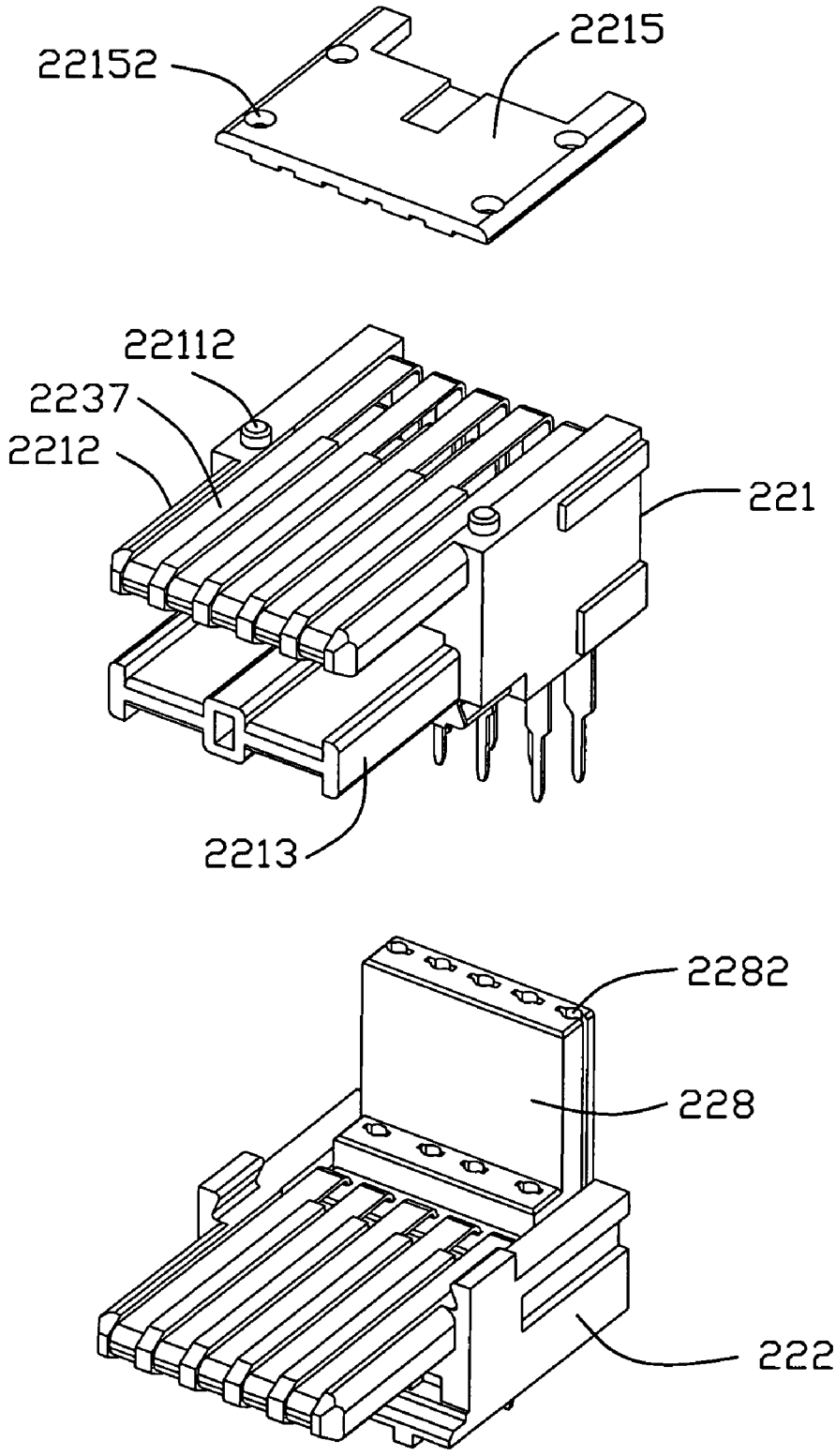
FIG. 26 is another partially exploded view without shield of the FIG. 24.
Figure 27:
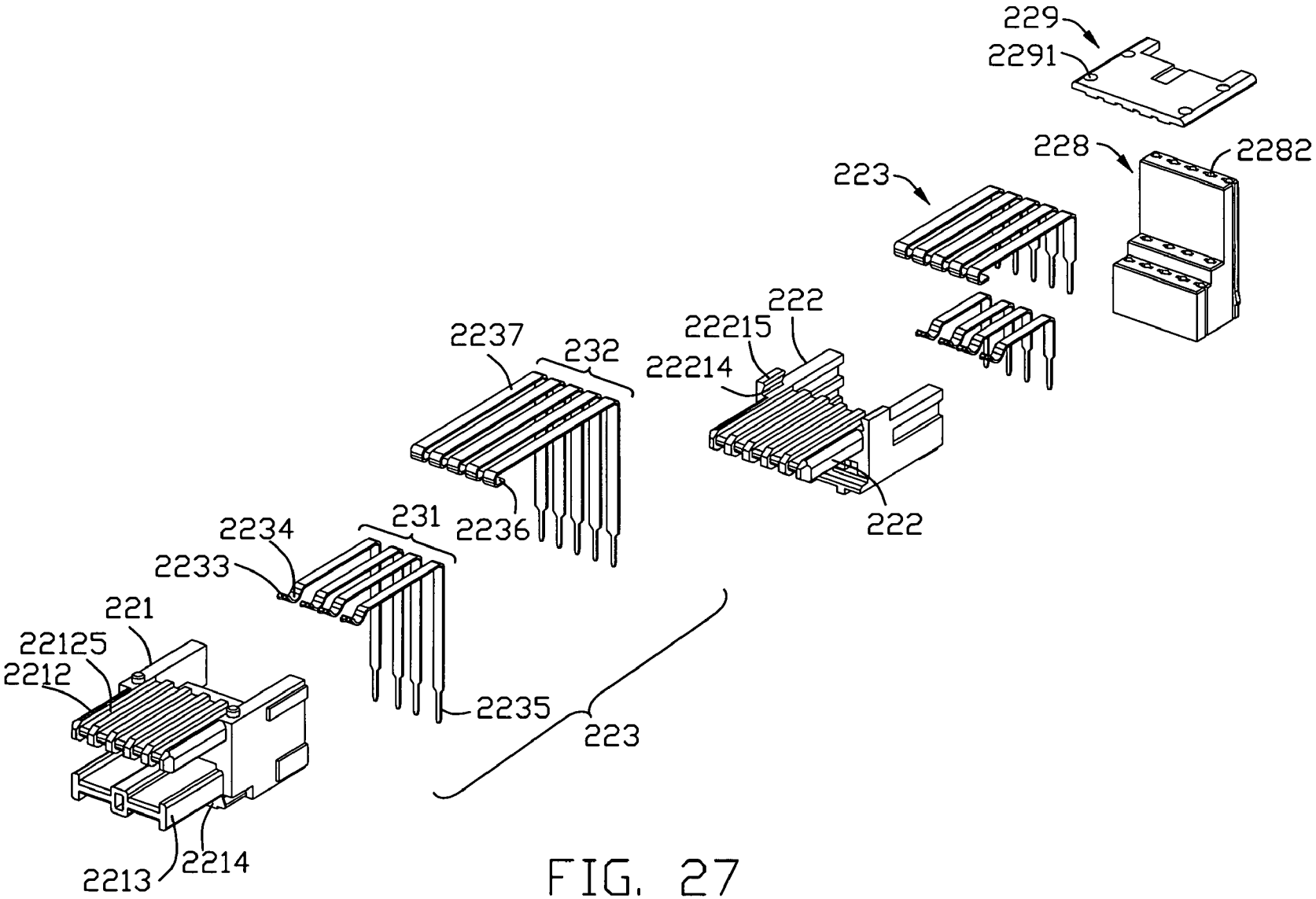
FIG. 27 is an exploded view of the stacked electrical connector shown in FIG. 26.
Figure 28:
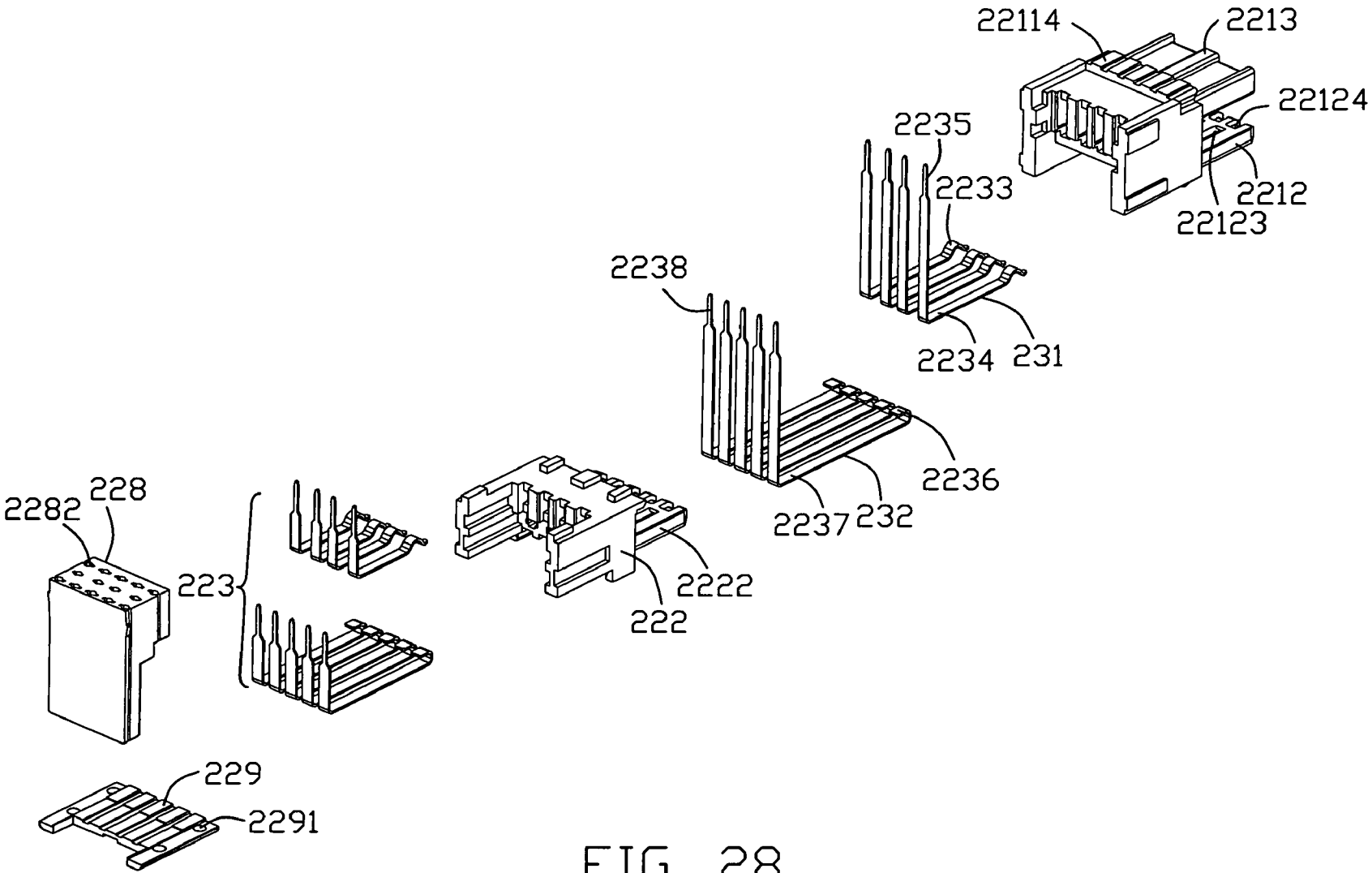
FIG. 28 is view similar to FIG. 27, while taken from another aspect.

Referring to FIGS. 22 and 23, two stacked electrical connector 18, 19 according to twelfth and thirteenth embodiment of the present invention are disclosed. The stacked electrical connector 18 comprises three mating interfaces 181, while the stacked electrical connector 19 comprises four mating interfaces 191. All mating interfaces 181, 191 are similar to the first mating interface in the first embodiment.

Referring to FIGS. 24-28, a stacked electrical connector 22 according to a fourteenth embodiment of the present invention are disclosed. The outside of the stacked electrical connector 22 is approximately same to the stacked electrical connector 15 when the stacked electrical connector 22, 15 are assembled together. The stacked electrical connector 22 comprises a divided housing 220 which is different from the insulative housing 151 in the tenth embodiment, two groups of contacts 223 which are similar to that in the tenth embodiment are retained in the divided housing 220, an outer shield 226 enclosing the divided housing 220, an rear shield 227 covering a rear end of the divided housing 220, and a spacer 228 positioned at a lower portion for fixing the contacts 223.

The divided housing 220 comprises an upper housing 221, a lower housing 222 positioned at a lower position of the upper housing 221 and a top cap 229 fixed at a top position of the upper housing 221. The upper housing 221 comprises a first mating interface with a first tongue 2212 extending forwardly form a top end thereof, and a clapboard 2213 parallel to the first tongue 2212 and located at a lower position thereof. An inner shield 225 encloses the clapboard 2213 and connects with the outer shield 226. The first tongue 2212 defines a plurality of first passageways 22125 at a top side thereof, a plurality of second and third passageways 22124, 22123 at a lower side thereof and arranged in two rows along a length direction of the first tongue 2212. The upper housing 221 comprises a pair of embosses 22112 projecting upwardly at a top end thereof, and a swallow-tailed projection 22114 at a lower end thereof. The top cap 229 defines a pair of holes 2291 engaging with the embosses 22112.

The lower housing 222 comprises a second mating interface with a second tongue 2222 extends forwardly from a top end of the lower housing 222. The second tongue 2222 is similar to the first tongue 2212, and the second mating interface is similar to the first mating interface. The lower housing 222 comprises a pair of block 22215 extending upwardly from two sides thereof. Each block 22125 defines a recess 22124 for engaging with the swallow-tailed projection 22114 of the upper housing 221. A.

Each group of contacts 223 is similar to the first contacts 20 in the first embodiment and transmit same signal with the first contacts 20. Each group of contacts 223 comprises four elastic contacts 2231 and five flat contacts 2232. We will describe one group contacts 223 positioned in the upper housing 221 for example. Each elastic contact 2231 comprises an elastic contact portion 2233 extending to the third passageways 22123 and protruding beyond the first tongue 2212, a securing portion 2234 retained in the upper housing 221 and a soldering portion 2235 extending out of the divided housing 220. Each flat contact 2232 comprises a flat contact portion 2236 extending to the second passageways 22124, a retention portion 2237 received in the first passageways 22125 and a tail portion 2238 extending out of the divided housing 220. The flat contact portions 2236 and the retention portion 2237 are parallel to each other, and wherein the flat contact portions 2236 are much shorter than the retention portions 2238. The flat contact portions 2236 and the elastic contact portions 2233 are arranged in two row along the length direction of the first tongue 2212 and do not contact with each other.

After the contacts 223 assembled in the divided housing 220, the top cap 229 covers the top end of the upper housing 221 and presses the retention portions 2237 for preventing the flat contacts 2232 from moving upwardly. The spacer 228 defines a plurality of hollows 2282 for fixing all contacts 223. Another group contacts 223 are arranged on the second tongue 2222 same as the arrangement of said one group contacts 223 above.

As fully described above, different embodiments of the present invention have been disclosed, but these are only some preferable embodiments used continually in fact, and such as a standard interface of POF connector, Module jack etc, can be stacked with a mating interface which is similar to the first mating interface in the first embodiment also for improving speed of signal transmission thereof, if it is necessary. All stacked electrical connectors described above have simple structure which is adapted to development trend of the electrical industry, and improve the speed of signal transmission thereof.

It is to be understood, however, that even though numerous, characteristics and advantages of the present invention have been set fourth in the foregoing description, together with details of the structure and function of the invention, the disclosed is illustrative only, and changes may be made in detail, especially in matters of number, shape, size, and arrangement of parts within the principles of the invention to the full extent indicated by the broad general meaning of the terms in which the appended claims are expressed.

What is claimed is:

1. An stacked electrical connector, comprising:

a first mating interface comprising a first receiving space with a first tongue received therein, and a plurality of first contacts retained therein, the first contacts comprising a plurality of first elastic contacts and a plurality of first flat contact, each first elastic contact having a securing portion fixed in the first mating interface, an elastic contact portion extending to the first tongue and a soldering portion, each first flat contact having a retention portion retained in the first mating interface, a flat contact portion extending to the first tongue and a tail portion, the first tongue having a pair of opposite upper face and lower face; and a second mating interface stacked with the first mating interface along a thickness direction of the first tongue, a plurality of second contacts retained in the second mating interface;

wherein the flat contact portions and the elastic contact portions are located at a same side of the upper face, and are arranged in two rows along a length direction of the first tongue, wherein a geometric profile of the first tongue is substantially same as what of a standard USB 2.0 A type receptacle, wherein the first elastic contacts are adapted for USB protocol and an arrangement of the first elastic contacts is compatible to a standard USB plug, wherein the first tongue defines a plurality of first passageways depressed from the upper face and a plurality of second passageways depressed from the lower face and communicating with the first passageways, the retention portions are received in the first passageways, and the fiat contact portions are received in the second passageways, wherein the first tongue defines a plurality of third passageways depressed from a lower face thereof, and the elastic contact portions are assembled in the third passageways and extend out of the lower face, the second passageways and the third passageways are arranged in two rows along the length direction and discontinuous with each other, wherein the first fiat contacts comprise two pairs of differential signal contacts and a grounding contact located therebetween, and the fiat contact portions of the signal and grounding contacts are juxtaposed with respect to each other in a width direction of the first tongue, wherein the second mating interface is different from the first mating interface.

2. The stacked electrical connector according to claim 1, wherein the second mating interface is same as the first mating interface, and the second mating interface comprises a second tongue, the second contacts are arranged on the second tongue same as an arrangement of the first contacts.

3. The stacked electrical connector according to claim 2, wherein the second mating interface comprises a second tongue, and each second contact has a mating portion arranged on one or two sides of the second tongue.

4. The stacked electrical connector according to claim 2, wherein the second mating interface comprises an annular recess with a cylindrical portion received therein, and the cylindrical portion defines a plurality of contact passageways extending therethrough, the second contact has a mating portion extending into the contact passageway.

5. The stacked electrical connector according to claim 2, wherein each first and second mating interface has a mating face connecting with a corresponding plug, wherein the mating faces of the first and second mating interface are arranged in an offset manner in both length direction and the thickness direction.

* * * * *